US009816237B2

(12) United States Patent
Loomis et al.

(10) Patent No.: US 9,816,237 B2
(45) Date of Patent: Nov. 14, 2017

(54) DEVICE FOR REINSTATEMENT OF A MICRO-TRENCH

(71) Applicant: Willamette Valley Company, Eugene, OR (US)

(72) Inventors: Robert Loomis, Aliso Viejo, CA (US); Jacob Goodwin, Creswell, OR (US)

(73) Assignee: Willamette Valley Company, Eugene, OR (US)

( * ) Notice: Subject to any disclaimer, the term of this patent is extended or adjusted under 35 U.S.C. 154(b) by 0 days.

(21) Appl. No.: 15/443,649

(22) Filed: Feb. 27, 2017

(65) Prior Publication Data

US 2017/0268184 A1 Sep. 21, 2017

Related U.S. Application Data

(63) Continuation-in-part of application No. 15/070,530, filed on Mar. 15, 2016.

(51) Int. Cl.

| | |
|---|---|
| ***E01C 19/00*** | (2006.01) |
| ***E01C 23/09*** | (2006.01) |
| ***E01C 19/48*** | (2006.01) |

(52) U.S. Cl.

CPC ..... *E01C 23/0966* (2013.01); *E01C 19/4873* (2013.01)

(58) Field of Classification Search

CPC ..... E01C 19/4873; E01C 19/0966; E01C 23/0966

USPC ..... 404/101, 104, 107, 111, 75, 108, 109

See application file for complete search history.

(56) References Cited

U.S. PATENT DOCUMENTS

| | | | | |
|---|---|---|---|---|
| 992,359 A | | 5/1911 | Kenney | |
| 1,212,906 A | | 1/1917 | Clark | |
| 1,543,922 A | | 6/1925 | Humphreys et al. | |
| 2,030,045 A | | 2/1936 | Billings | |
| 2,682,716 A | | 7/1954 | Burkholder | |
| 3,015,261 A | | 1/1962 | MacDonald | |
| 3,181,258 A | | 5/1965 | Duncan | |
| 4,502,814 A | * | 3/1985 | Trimble | E01C 23/0973 401/265 |
| 4,630,965 A | * | 12/1986 | Nguyen | C08L 95/00 222/175 |

(Continued)

FOREIGN PATENT DOCUMENTS

EP 0164242 B1 12/1989

OTHER PUBLICATIONS

Micro-trench Reinstatement, Technical Advice Note 11-09, TAN11-09 Micro-trench reinstatement Issue 2, 2011, 10 pages.

*Primary Examiner* — Raymond W Addie

(74) *Attorney, Agent, or Firm* — Brinks Gilson & Lione

(57) ABSTRACT

A device for reinstatement of a micro-trench that includes a hopper. The hopper includes a top opening and a bottom opening, the top opening being larger than the bottom opening. The device also includes a valve portion connected to the bottom opening of the hopper and a tube connected to the valve portion. The device also includes a dynamic plate portion including a top opening, a bottom opening, and a conduit between the top and bottom openings. The top opening of the plate portion is connected to the tube, and the bottom opening includes a length and a width. The dynamic plate portion allows the device to maintain positive contact with the pavement even when the surface of the pavement is angled or uneven.

20 Claims, 13 Drawing Sheets

(56) References Cited

U.S. PATENT DOCUMENTS

| | | | | |
|---|---|---|---|---|
| 4,767,234 | A * | 8/1988 | Rizzo | E01C 23/098 118/108 |
| 5,498,103 | A * | 3/1996 | Bauer, III | E01C 23/0973 404/107 |
| 6,290,428 | B1 * | 9/2001 | Hall | E01C 23/0973 15/103.5 |
| 6,439,806 | B1 * | 8/2002 | Dillingham | E01C 19/45 126/343.5 A |
| 6,543,961 | B1 * | 4/2003 | Rensel | E04G 21/04 222/181.2 |
| 6,809,294 | B2 * | 10/2004 | Velinsky | B05C 5/02 219/213 |
| 7,255,512 | B2 | 8/2007 | Wallace | |
| 7,641,420 | B2 * | 1/2010 | Becker | E01C 19/17 404/107 |
| 8,439,599 | B2 * | 5/2013 | Schmidt | E01C 23/0973 118/108 |
| 8,480,332 | B2 | 7/2013 | Miller | |
| 8,562,249 | B2 | 10/2013 | Owegeser | |
| 2002/0044830 | A1 | 4/2002 | Munie | |
| 2004/0062607 | A1 * | 4/2004 | Harvey | E01C 23/098 404/107 |
| 2010/0322710 | A1 * | 12/2010 | Ryan | E01C 23/06 404/78 |
| 2011/0085860 | A1 * | 4/2011 | Gregerson | E01C 23/06 404/107 |
| 2014/0144051 | A1 | 5/2014 | Sewell | |

* cited by examiner

DEVICE FOR REINSTATEMENT OF A MICRO-TRENCH

RELATED APPLICATIONS

The present patent document is a continuation-in-part of and claims the benefit and priority of U.S. application Ser. No. 15/070,530, filed on Mar. 15, 2016. The foregoing application is hereby incorporated by reference in its entirety.

BACKGROUND

1. Technical Field Text

The present invention relates to a device and method used for reinstatement of a micro-trench in pavement.

2. Background Information

Fibre broadband is a type of broadband that uses fibre optic cables to increase the speed of a broadband connection. An extensive network of fibre optic cables allows for fibre to the property (FTTP) or fibre to the home (FTTH) connections to make fibre broadband available to commercial and residential customers. To create such an extensive network, fibre optic cables or a duct of fibre optic cables may be installed in a road, such as a highway surface or pavement, or a footway, such as a sidewalk or pavement, that provides a protected structure for the fibre optic cables or the duct of fibre optic cables.

The installation of fibre optic cables in existing pavement requires creating or cutting a trench in the pavement, laying of the fibre optic cables, and then backfilling of the trench. In the past, open trench excavation has been used to create trenches in pavement to conduct, for example, sewer construction, repair or replacement. However, open trench excavation is time-consuming, expensive and disruptive to traffic, pedestrians and residents, especially when roads need to be closed to conduct the open trench excavation.

Micro-trench machines have been developed to create micro-trenches within pavement and lay the fibre optic cables within the micro-trenches. The micro-trenches are smaller in size than open trench excavation and less disruptive to traffic, pedestrians and residents. These micro-trench machines also create an efficient method of creating or cutting micro-trenches and laying the fibre optic cables within the micro-trenches. After the micro-trench has been created and the fibre optic cables have been laid in the trench, the micro-trench needs to be backfilled and the pavement repaired to its original level and condition. This process is known as reinstatement. In the past, reinstatement of a micro-trench has been conducted manually or using a machine that is unable to precisely and accurately pour the backfill material into the micro-trench and also have the pavement repaired to its original level and condition.

For example, with manual reinstatement, a person will position a duct, hose or similar tubing within the micro-trench and backfill material will flow from the duct into the micro-trench. The person will walk along the length of the micro-trench with the duct to backfill the micro-trench. This form of manual reinstatement of micro-trenches is inefficient and expensive. Specifically, a person has to walk every inch of pavement where a micro-trench has been created to backfill the micro-trench and level out the backfill material to restore the pavement to its original level and condition. This manual process requires significant manpower and elongates disruption to road users, communities and residents.

As the installation speed of fibre optic cables is essential to serve future customers, a need exists for devices and methods that provide fast and efficient deployment of a reinstatement material into the micro-trenches and restore the pavement to its original level and condition prior to micro-trenching.

BRIEF SUMMARY

This invention concerns devices and processes used for reinstatement of a micro-trench that increase the speed of reinstatement and maintain the integrity and level of the pavement after reinstatement.

One aspect of the present invention relates to a device for reinstatement of a micro-trench that includes a hopper. The hopper includes a top opening and a bottom opening, the top opening being larger than the bottom opening. The device also includes a valve portion connected to the bottom opening of the hopper and a tube connected to the valve portion. The device also includes a dynamic plate portion including a top opening, a bottom opening, and a conduit between the top and bottom openings. The top opening of the plate portion is connected to the tube, and the bottom opening includes a length and a width.

Another aspect of the present invention relates to a machine-powered device for reinstatement of a micro-trench that includes a hopper. The hopper includes a top opening and a bottom opening, the top opening being larger than the bottom opening. The device also includes a valve portion connected to the bottom opening of the hopper and a flexible tube connected to the valve portion. The device also includes a plate portion that includes a top opening, a bottom opening, and a conduit between the top and bottom openings. The top opening of the plate portion is connected to the flexible tube.

Another aspect of the present invention relates to a machine-powered device for reinstatement of a micro-trench that includes a frame support. The device also includes a hopper that is positioned within the frame support and is rotatably connected to the frame support. The device also includes a valve portion that is connected to the bottom opening of the hopper and a flexible tube that is connected to the valve portion. Also, the device includes a plate portion that includes a top opening, a bottom opening, and a conduit between the top and bottom openings. The top opening of the plate portion is connected to the flexible tube and the bottom opening includes a length and a width.

Another aspect of the present invention relates to a device for manual reinstatement of a micro-trench. The device includes a hopper having a first opening and a second opening. The first opening of the hopper is located at a location higher than the second opening within the hopper. The device also includes a valve portion connected to the second opening of the hopper, a tube connected to the valve portion, and a dynamic plate portion. The dynamic plate portion includes a top opening, a bottom opening, and a conduit between the top and bottom openings, and the top opening is connected to the tube and the bottom opening has a length and a width.

Another aspect of the present invention relates to a device for reinstatement of a micro-trench. The device includes a hopper having a first opening and a second opening, and the first opening is at a location higher than the second opening within the hopper. The devices also includes a panel that supports the hopper, a valve portion connected to the second opening of the hopper, a tube connected to the valve portion, and a dynamic plate portion. The dynamic plate portion includes a top opening, a bottom opening, and a conduit between the top and bottom openings, and the top opening is connected to the tube and the bottom opening has a length and a width. The device also includes a plurality of wheels connected to the panel.

Another aspect of the present invention relates to a method for reinstating a micro-trench. The method includes presenting a device that includes a hopper having a first opening and a second opening, and the first opening is at a location higher than the second opening within the hopper. The devices also includes a valve portion connected to the second opening of the hopper, a tube connected to the valve portion, and a dynamic plate portion having a top opening, a bottom opening, and a conduit between the top and bottom openings. The top opening is connected to the tube. The method also includes positioning the bottom opening of the dynamic plate portion over a micro-trench, dispensing material through the bottom opening of the dynamic plate portion into the micro-trench, moving the hopper along the micro-trench such that the bottom opening of the dynamic plate portion maintains its position above the micro-trench, and leveling the material dispensed into the micro-trench via the dynamic plate portion.

The accompanying drawings, which are incorporated herein and constitute part of this specification and, together with the general description given above and the detailed description given below, serve to explain features of the present invention.

DETAILED DESCRIPTION OF THE DRAWINGS AND THE PRESENTLY PREFERRED EMBODIMENTS

Figure 1:
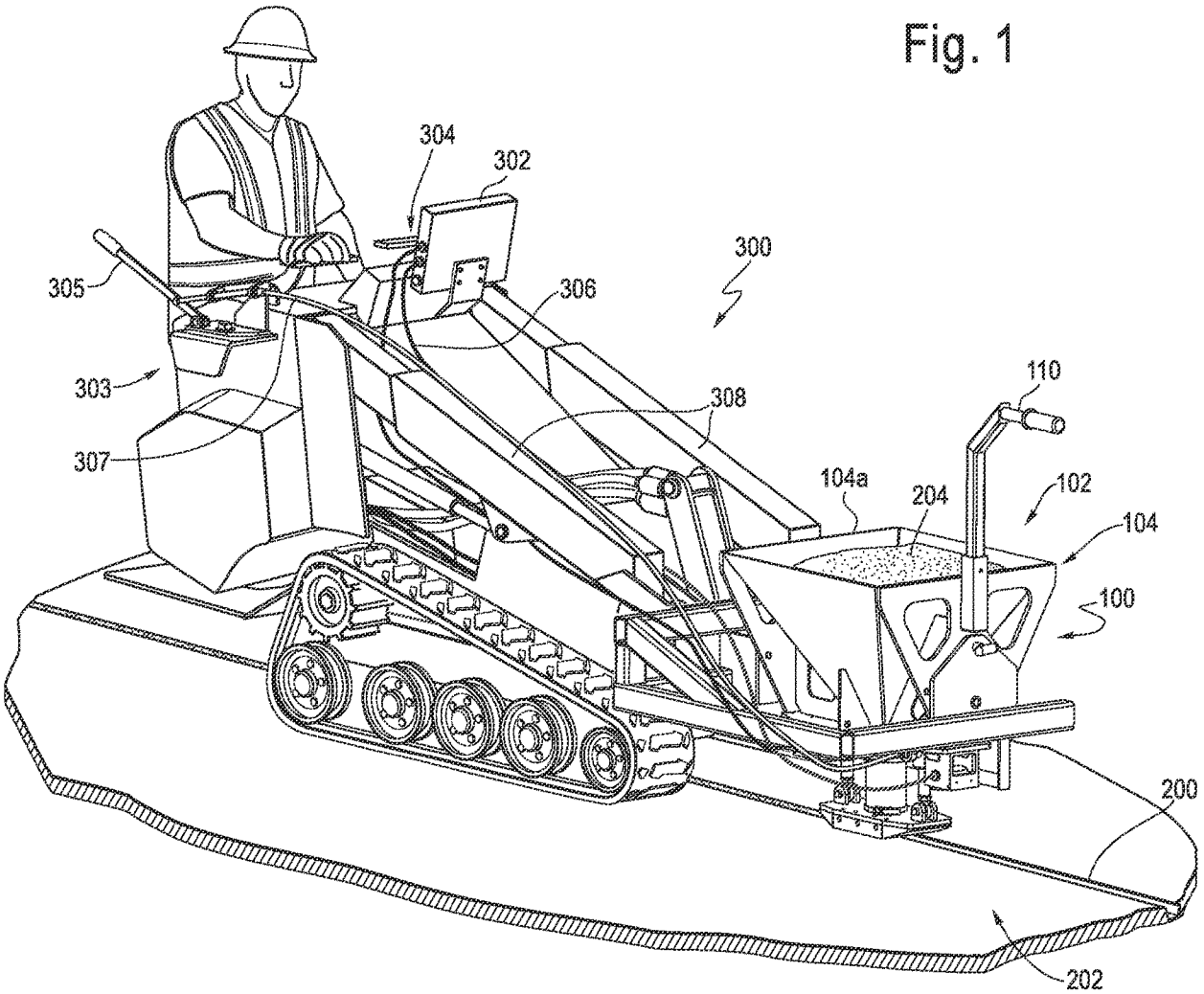
FIG. 1 shows a perspective view of an embodiment a machine-powered device for reinstatement of a micro-trench in use.

In the following detailed description of the embodiments of a device for reinstatement of a micro-trench, like elements and structures are numbered and/or labeled alike. The relationship and functioning of the various elements of the embodiments may be better understood by reference to the following detailed description. However, embodiments are not limited to those illustrated in the drawings. It should be understood that the drawings may be, but are not necessarily to scale, and in certain instances details may have been omitted that are not necessary for an understanding of embodiments disclosed herein.

Machine-Powered Device for Reinstatement of a Micro-Trench

FIGS. 1-8 show an embodiment of a device 100 for reinstatement of a micro-trench 200. As shown in FIG. 1, the micro-trench 200 includes a width, a length, and a depth and is formed within pavement 202. The pavement 202 may include asphalt, concrete or cement. As described above, after the micro-trench 200 has been created and fibre optic cables have been laid in the micro-trench 200, the micro-trench 200 needs to be backfilled with material 204 and the pavement 202 repaired to its original level and condition. This process is known as reinstatement.

The material 204 used to reinstate the micro-trench 200 may include a polymer blend of recycled and renewable materials, such as FastPatch DPR made by Willamette Valley Company, or other repair material for distressed pavement. The material 204 may be fast-curing with a cure time of less than approximately 45 minutes and may be applied in warm or cooler climates. The fast-curing property of the material 204 increases the efficiency of the reinstatement process and minimizes traffic interruptions. The material 204 may also be used with an accelerator, such as the FastPatch Kicker made by Willamette Valley Company, to further decrease the curing time of the material 204.

To advance or push the device 100 along the pavement 202 to reinstate the micro-trench 200, the device 100 may be attached to a machine 300 as shown in FIG. 1. The machine 300 used may be one known in the art, such as a Ditch-Witch® SK850, that is engine-powered and in this embodiment supplies the necessary power and force to push the device 100 along the pavement 202 over the micro-trench 200. The machine 300 may include one or more forks or arms 308 connected to a mount plate (not shown). The mount plate is used to attach the device 100 to the machine 300. When the device 100 is attached to the machine 300, the arms 308 of the machine 300 allow the machine 300 to lift or lower the device 100 and position the device 100 over the micro-trench 200.

The propulsion force applied to the device 100 by the machine 300 must be sufficient to overcome the static friction between the device 100 and the pavement 202 to advance the device 100 along the pavement 202. When the device 100 is filled with material 204, the weight of the device 100 with the material 204 may create a significant force of static friction requiring the power of the machine 300 to supply the necessary force to overcome the force of static friction. The amount of propulsion force necessary to overcome the force of static friction depends on the size of the device 100 and the amount of material 204 within the device 100 at a particular time during use. Thus, the amount of force necessary may vary, i.e. be smaller or larger, depending on the size of the device 100 and the amount of material 204 within the device 100.

The machine 300 may also include a display 302 mounted on a dash of the machine 300 that displays diagnostics and other readouts of the machine 300. The display 302 also includes a plurality of cable connections 304 for connecting cables 306 between the device 100 and the display 302. The machine 300 may also include a lever assembly 303 including a mechanical lever 305, a rod 307, and a connecting cable 309 positioned within the rod 307, for use with a valve portion of the device 100, described in greater detail below.

Figure 3:
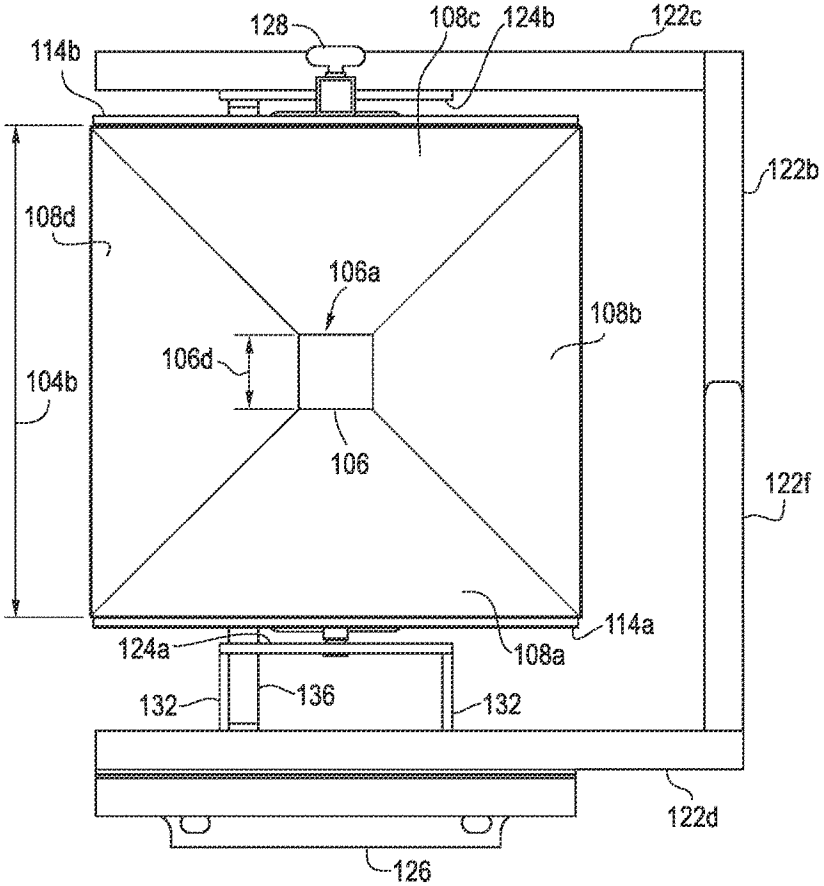
FIG. 3 shows a top view of the device of FIG. 1.
Figure 7B:
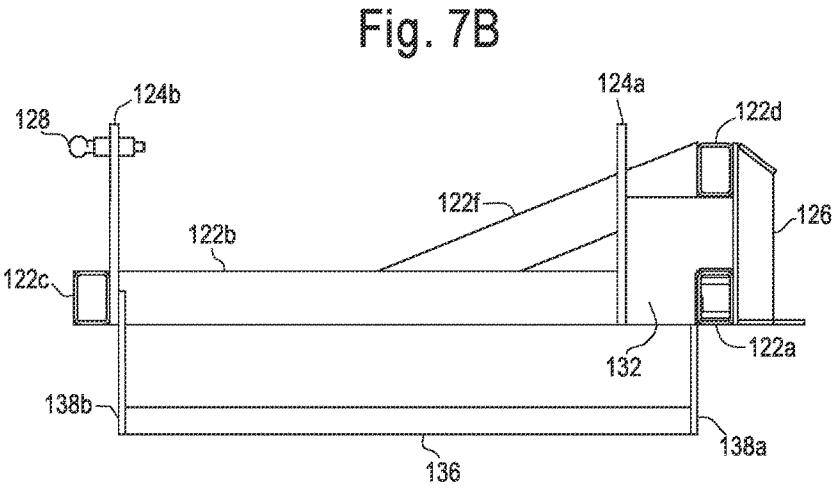
FIG. 7B shows a side view of a frame of the device of FIG. 1.
Figure 7A:
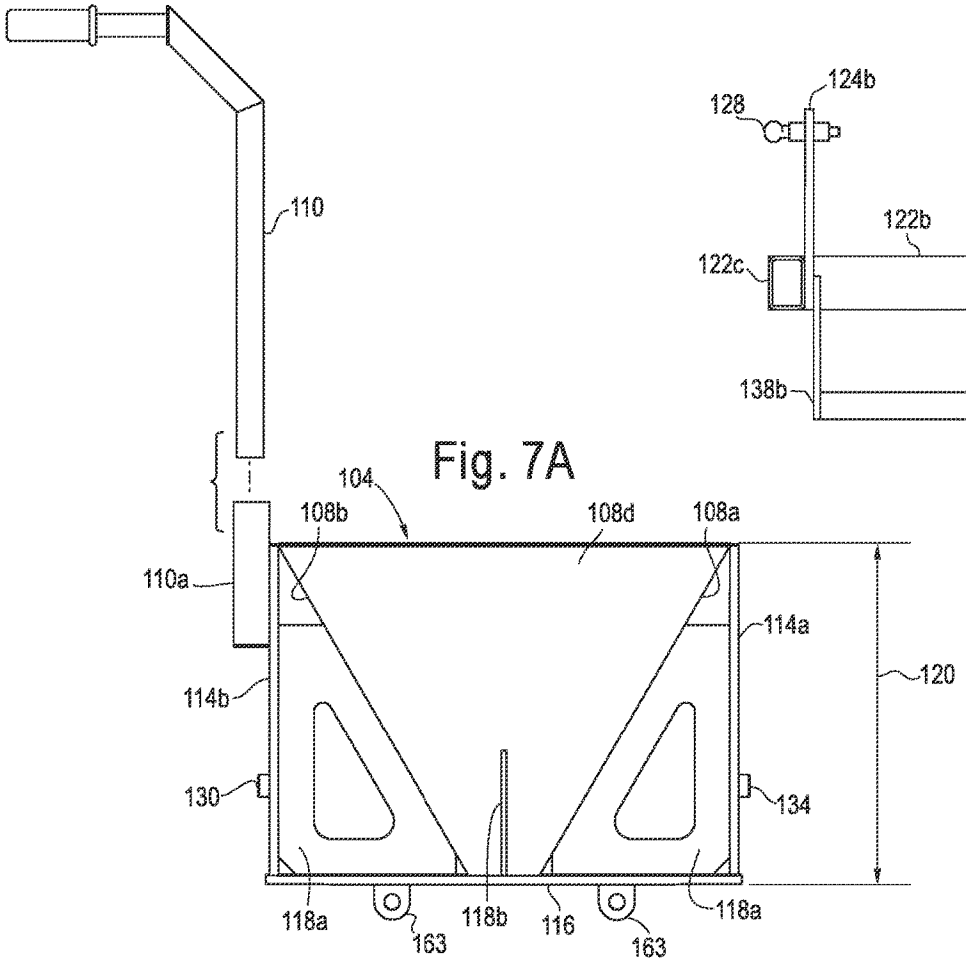
FIG. 7A shows a side view of a hopper and a sub-frame assembly of the device of FIG. 1.

As shown in, for example, FIGS. 1 and 3, the device 100 includes a hopper 102 that includes a top 104, a top or a first opening 104*a*, a bottom 106, a bottom or a second opening 106*a*, one or more walls 108 that taper from the top 104 to the bottom 106 of the hopper 102, and a depth 120, as shown in FIG. 7A. The hopper 102 is a container for the material 204 that tapers downward and is able to discharge the material 204 through the bottom opening 106*a*. The hopper 102 may include a rectangular, square or circular shape, and the top opening 104*a* and bottom opening 106*a* may also include a corresponding rectangular, square or circular shape. The hopper 102 as described herein is described having a square shape for illustration purposes and includes four walls 108*a*, 108*b*, 108*c*, and 108*d*. The top opening 104*a* includes a width 104*b* larger than a width 106*b* of the bottom opening 106*a*, as shown in FIG. 3.

The material of the hopper 102 may include steel, iron, other metal alloys, plastics, or a material that is adhesion resistant and chemical resistant. The dimensions of the hopper 102 may vary to accommodate a specific volume of material 204. For example, the hopper 102 may be able to accommodate 12 to 15 gallons of material 204; however, the hopper 102 may also be able to accommodate more or less than 12-15 gallons of material 204 depending on its dimensions. As a result of the fast-curing property of the material 204, some material 204 may affix to the walls 108 of the hopper 102 during the reinstatement process. To prevent buildup of material 204 along the walls 108, the walls 108 may include a smooth surface to allow for easy scraping of the material 204 off of the walls 108. A liner or other material, such as a type of grease, may also be applied to the walls 108 of the hopper 102 to help prevent buildup of material 204 on the walls 108 of the hopper 102 and ease removal of excess material 204 from the walls 108.

The material 204 may be poured into the top opening 104*a* of the hopper 102 either manually through a tube, pump or similar device after the material 204 is mixed or using a machine that may mix the material 204 and pour the material 204 into the hopper 102. If a machine is used, the machine may travel alongside the machine 300 during operation to refill the hopper 102 with material 204.

Figure 2:
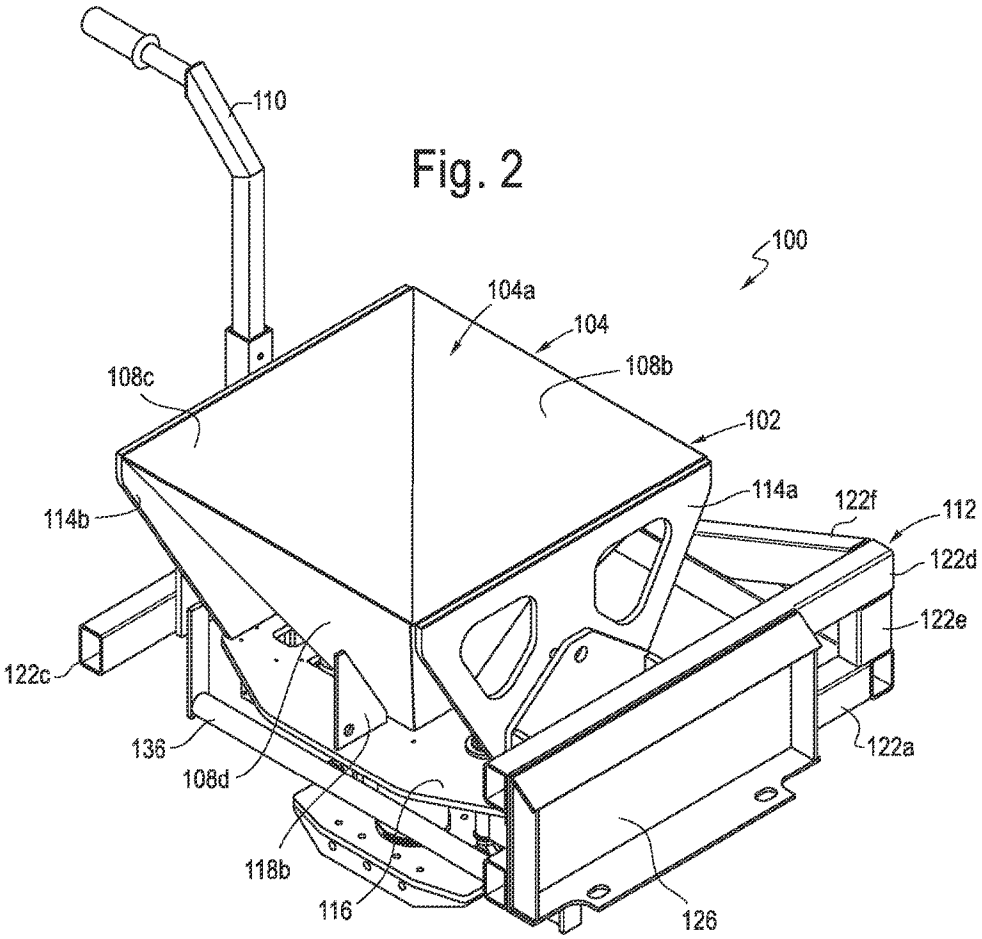
FIG. 2 shows a perspective view of the device of FIG. 1 in an operating position.

As shown in FIG. 2, the device 100 also includes a frame 112 for supporting the hopper 102. For attachment between the frame 112 and the hopper 102, the device 100 may include a sub-frame assembly that may be integral within the hopper 102 via a weld, bond, or adhesive. The material of the sub-frame assembly may be the same as the material of the hopper 102 and may include steel, iron, other metal alloys, plastics, or a material that is adhesion resistant and chemical resistant.

The sub-frame assembly includes at least two vertical side panels 114*a*, 114*b*, a bottom panel 116, and at least four triangular support panels 118 including two large triangular support panels 118*a* and two small triangular support panels 118*b*. FIG. 7A shows a side view of the hopper 102 and the sub-frame assembly. The sub-frame assembly provides support for the hopper 102 and a surface for connection of the hopper 102 to the frame 112 without creating holes for pins, screws, bolts, or other mechanical fasteners into the walls 108 of the hopper 102, which allows the walls 108 of the hopper 102 to maintain a smooth surface as discussed above.

As shown in FIGS. 2-3 and 7A, the at least two vertical side panels 114*a* and 114*b* correspond with two opposing walls 108*a* and 108*c* of the hopper 102. The side panels 114*a*, 114*b* may include a top, a bottom, a length, and two sides that taper from the top to the bottom. Thus, the width of the top of each side panel 114*a*, 114*b* may be larger than the width of the bottom of each side panel 114*a*, 114*b*. Each side panel is connected to the top 104 of the hopper 102 along the width of the corresponding wall 108*a*, 108*c* and then extends vertically for a length, which is the same as the depth 120 of the hopper 102. The bottom of each side panel 114*a*, 114*b* is connected to the bottom panel 116 of the sub-frame assembly.

The bottom panel 116 of the sub-frame assembly includes a length and a width, which correspond with the length and width of the top opening 104*a* of the hopper 102, and is positioned concentrically below the top opening 104*a* of the hopper 102. The bottom panel 116 is connected to the bottom 106 of the hopper 102 and includes an opening that corresponds with the bottom opening 106*a* of the hopper 102 to allow material 204 to pass through the opening of the bottom panel 116.

The triangular support panels 118*a* are positioned on the top surface of the bottom panel 116 and between each side panel 114*a*, 114*b* and each corresponding wall 108*a*, 108*c* of the hopper 102, as shown in FIG. 7A. The triangular support panels 118*a* support the hopper 102 and prevent movement of the hopper 102 toward the side panels 114*a*, 114*b*. As described above, the triangular support panels 118*b* may be smaller than the triangular support panels 118*a*. The triangular support panels 118*b* may also be positioned on the top surface of the bottom panel 116 and connected to the remaining two walls 108*b*, 108*d* of the hopper 102 to support the hopper 102 and also prevent movement of the hopper 102. Thus, the at least four triangular support panels 118 prevent lateral (sideways) and longitudinal (forward and backward) movement of the hopper 102 within the sub-frame assembly.

Figure 8:
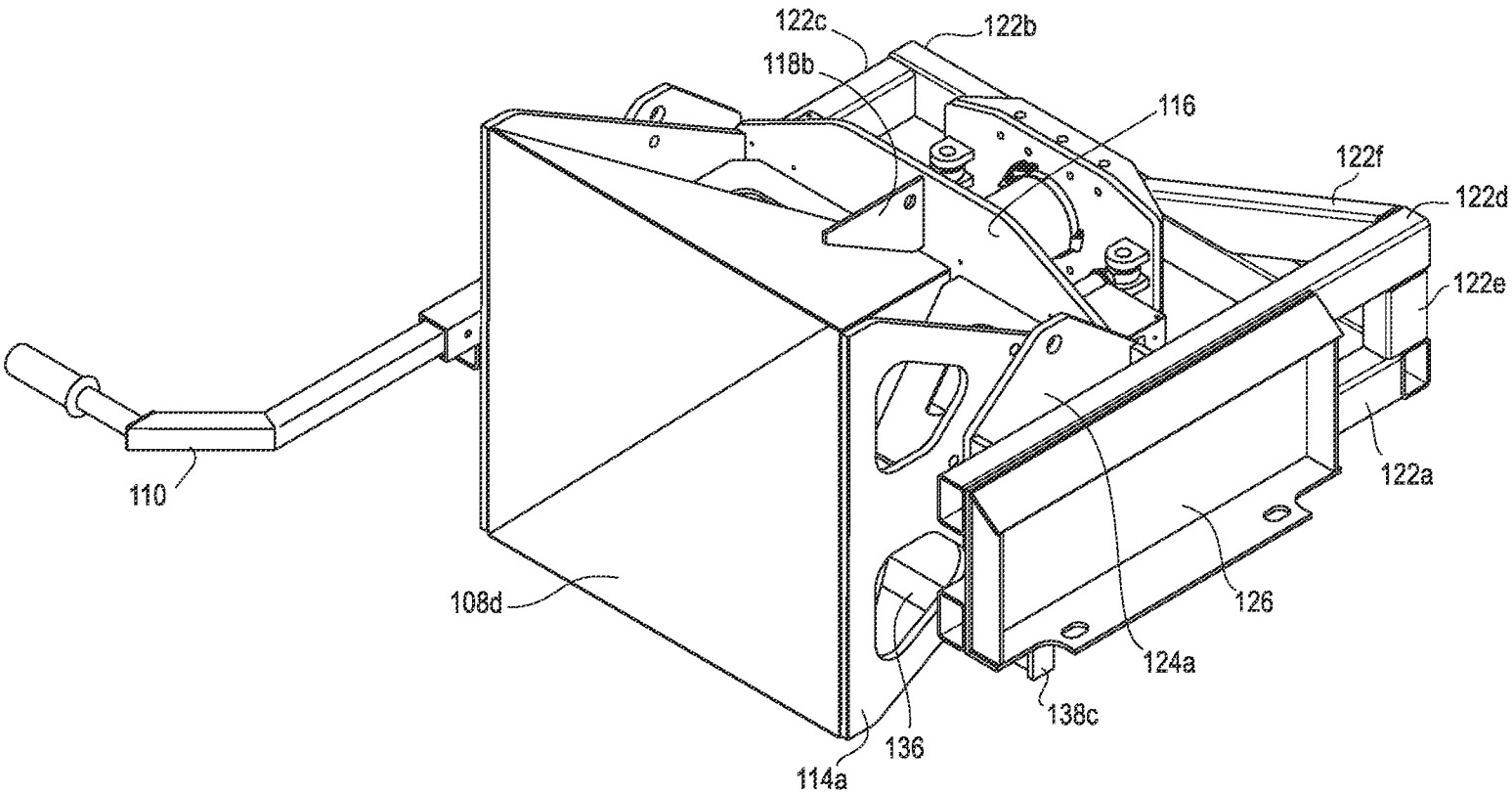
FIG. 8 shows a perspective view of the device of FIG. 1 in a servicing position.

The device 100 may also include a handle 110 attached to one of the side panels 114 of the sub-frame assembly. As shown in FIGS. 2 and 7A, the handle 110 may be attached to panel 114*b* of the sub-frame assembly. The handle 110 may be positioned within and mechanically fastened to a rectangular slot 110*a* that is connected to the side panel 114*b* of the sub-frame assembly, as shown in FIG. 7A. The handle 110 provides a mechanism for an operator to manipulate movement of the device 100. For example, the handle 110 may be used for an operator to grip and push or pull the device 100 when the device 100 is not attached to the machine 300. The handle 110 may also be used to facilitate rotation of the hopper 102 of the device 100 from an operating position, as shown in FIGS. 1-6, to a servicing position for cleaning and servicing the hopper, as shown in FIG. 8.

The sub-frame assembly is rotatably connected to the frame 112 of the device 100 via the side panels 114*a*, 114*b* of the sub-frame assembly. The ability to rotate the sub-frame assembly, which rotates the hopper 102, allows the hopper 102 to transition from the operating position to the servicing position. The material of the frame 112 may be the same as the sub-frame assembly and may include steel, iron, other metal alloys, plastics, or a material that is adhesion resistant and chemical resistant. As shown in FIGS. 2-6 and 7B, the frame 112 partially surrounds the sub-frame assembly and the hopper 102 and includes a plurality of interconnected bars 122, at least two connecting panels 124*a*, 124*b*, and a mount 126. The bars 122 may be mechanically fastened, via screws, bolts, nuts, and/or washers, together or integral with each other via a weld, bond, or adhesive. The panels 124*a*, 124*b* may include a generally pentagon or triangular shape.

As shown in FIGS. 2-6 and 7B, three of the bars 122*a*, 122*b*, 122*c* partially surround the hopper 102. A fourth bar that would be connected to bars 122*a* and 122*c* to form a square is not included to allow the hopper 102 to rotate from the operating position to the servicing position, as shown in FIG. 8. Beginning with the bar 122*c*, the bar 122*c* has one free end portion and one end portion connected to the bar 122*b* and is generally parallel to wall 108*c* of the hopper 102. The bar 122*c* is also connected to one of the connecting panels 124*b* along part of the length of bar 122*c*, as shown, for example, in FIG. 3. The bar 122*c* may be mechanically attached to the connecting panel 124*b*, via screws, bolts, nuts, and/or washers, or attached to the connecting panel via welding, bonding, or adhesive. The connecting panel 124*b* is then connected to panel 114*b* of the sub-frame assembly.

Figure 6:
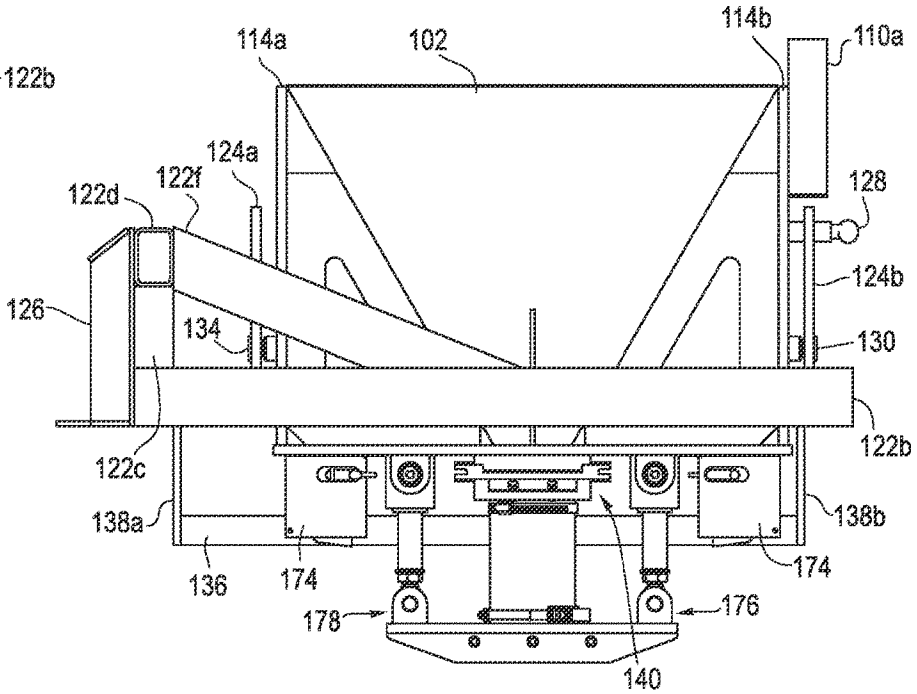
FIG. 6 shows a side view of the device of FIG. 1.

As shown in FIGS. 2-3, 6, and 7B, the connecting panel 124*b* is mechanically connected to panel 114*b* of the sub-frame assembly to support the sub-frame assembly yet also allow the sub-frame assembly and the hopper 102 to rotate between the operating and servicing positions. For example, as shown in FIGS. 6 and 7A, the panel 124*b* may be mechanically fastened to panel 114*b* at approximately the center of panel 124*b* at attachment location 130.

The connecting panel 124*b* may also be connected to panel 114*b* via a rod 128 with a corresponding handle, as shown in, for example, FIG. 6. The panel 114*b* may include one or more holes (not shown) for insertion of the rod 128 through one of holes. The holes may be positioned in a series adjacent to one another such that when the hopper 102 is the operating position, the rod 128 may be inserted through the middle of the three holes to lock the hopper 102 in position. When the hopper 102 is rotated from the operating position into the servicing position, the rod 128 is pulled out, the hopper 102 is rotated, for example using the handle 110, and the rod 128 is inserted back into one of the adjacent holes to lock the hopper 102 in the servicing position. Once the hopper 102 has been cleaned or the remaining material 204 removed, the rod 128 is removed from the hole, the hopper 102 is rotated back to the operating position, and the rod 128 is inserted back into the middle of the three holes to lock the hopper 102 in the operating position.

Figure 4:
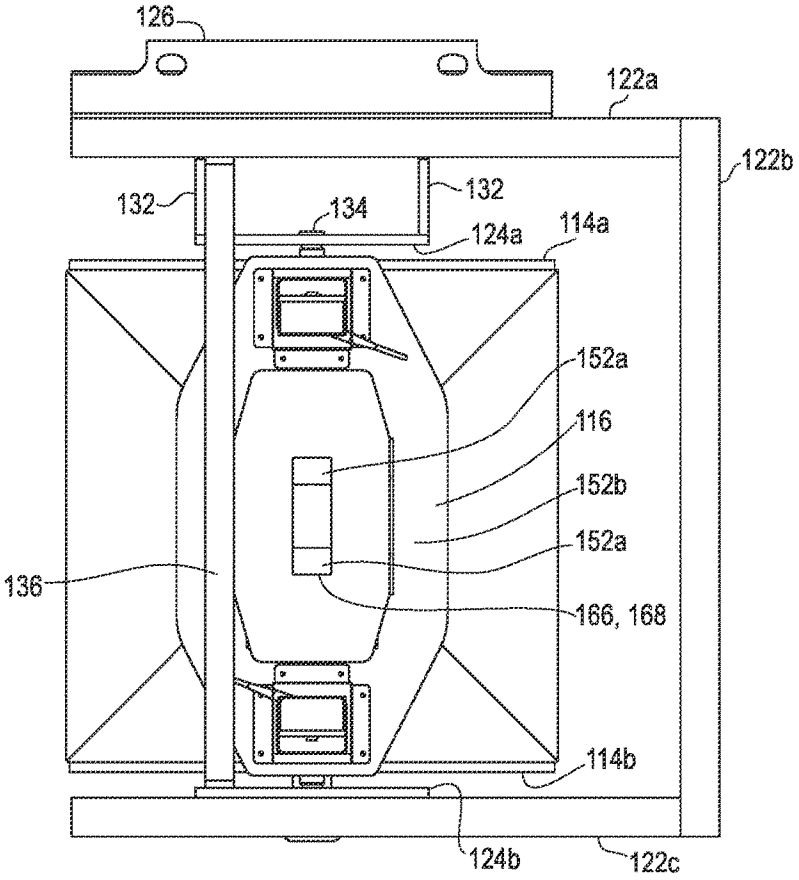
FIG. 4 shows a bottom view of the device of FIG. 1.

As shown in FIGS. 3-4 and 7B, the bar 122*b* of the frame 112 is connected at both of its end portions with one end portion connected to bar 122*c* and the other end portion connected to bar 122*a*. The bar 122*b* is generally parallel to wall 108*b* of the hopper 102 and is not directly connected to either the hopper 102 or the sub-frame assembly. The bar 122*a* of the frame 112, similar to bar 122*c*, has one free end portion and one end portion connected to bar 122*b*. The bar 122*a* is generally parallel to wall 108*a* of the hopper 102. As shown in FIG. 2, another bar 122*d* is positioned above and parallel to bar 122*a*. The two bars 122*a* and 122*d* provide points of attachment for the mount 126 of the frame 112, described in more detail below. As shown in FIGS. 2 and 6, another bar 122*e* connects bars 122*a* and 122*d* and is perpendicular to bars 122*a*, 122*d*. Another bar 122*f* is connected to bars 122*b*, 122*d*, and 122*e* to support bars 122*d* and 122*e*. The bar 122*f* is angled with respect to bar 122*b*.

The mount 126 of the frame 112 is connected to bars 122*a*, 122*d* of the frame 112 via a mechanical connection, such as screws, bolts, nuts, and/or washers, or via an integral connection, such as a weld, bond or adhesive, as shown in FIG. 2. The mount 126 attaches to the mount plate of the machine 300 for attachment of the device 100 to the machine 300. As described above, the mount plate of the machine 300 is connected to the arms 308 of the machine 300, which allow the machine 300 to lift or lower the device 100 and position the device 100 over the micro-trench 200.

To connect bars 122*a*, 122*d* and the mount 126 to the sub-frame assembly, the frame 112 may also include two L-shaped panels 132, as shown in FIGS. 3-4 and 7B. The L-shaped panels 132 are positioned between the mount 126, the bars 122*a*, 122*d*, and the connecting panel 124*a*. The L-shaped panels 132 are welded, bonded, or adhered to the mount 126 and the connecting panel 124*a*.

Similar to the connecting panel 124*b*, the connecting panel 124*a* is mechanically connected to panel 114*a* of the sub-frame assembly to support the sub-frame assembly and the hopper 102 yet also allow the hopper 102 to rotate between the operating and servicing positions. The connecting panel 124*a* may be mechanically fastened to panel 114*a* at approximately the center of panel 124*a* at attachment location 134. Similar to the connecting panel 124*b*, the connecting panel 124*a* may also be connected to panel 114*a* via a rod with a corresponding handle (not shown). The rod would serve the same purpose as rod 128, i.e. to lock the hopper 102 in place in either the operating position or servicing position, and the panel 114*a* may include one or more corresponding holes for insertion of the rod through one of holes.

The frame 112 may also include a shaft 136, as shown in FIGS. 2, 4, 6, 7B and 8. The shaft 136 is positioned under the hopper 102, when the hopper 102 is in the operating position, and is generally parallel the bar 122*b*. Each end of the shaft 136 is attached to a rectangular connecting panel 138. As shown in FIG. 7B, one of the rectangular connecting panels 138*a* is connected to the bar 122*a*, and the other rectangular connecting panel 138*b* is connected to panel 124*b* of the frame 112.

The connecting panels 138*a*, 138*b* may be connected to the bar 122*a* and the panel 124*b*, respectively, via a mechanical connection, such as screws, bolts, nuts, and/or washers, or via an integral connection, such as a weld, bond, or adhesive. The connecting panels 138*a*, 138*b* position the shaft 136 below the bars 122*a*, 122*b*, 122*c* and closer to the ground. The shaft 136 provides a stop for the hopper 102 when the hopper 102 is rotated from the operating position to the servicing position, as shown in FIG. 8. Specifically, the shaft 136 prevents the hopper 102 from rotating any further beyond the shaft 136 and also provides a surface for the hopper 102 to position on top of in the servicing position.

The device 100 may also include a plurality of legs (not shown) connected to the bars 122*a*, 122*b*, 122*c* of the frame 112 of the device 100. Each leg may include a wheel (not shown) to facilitate movement of the device 100 when the device 100 is not attached to the machine 300.

Figure 7D:
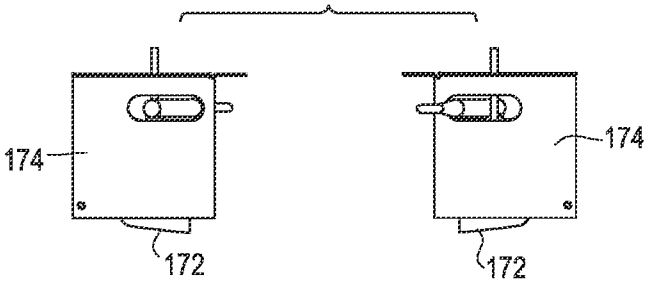
FIG. 7D shows a side view of two cameras of the device of FIG. 1.
Figure 7C:
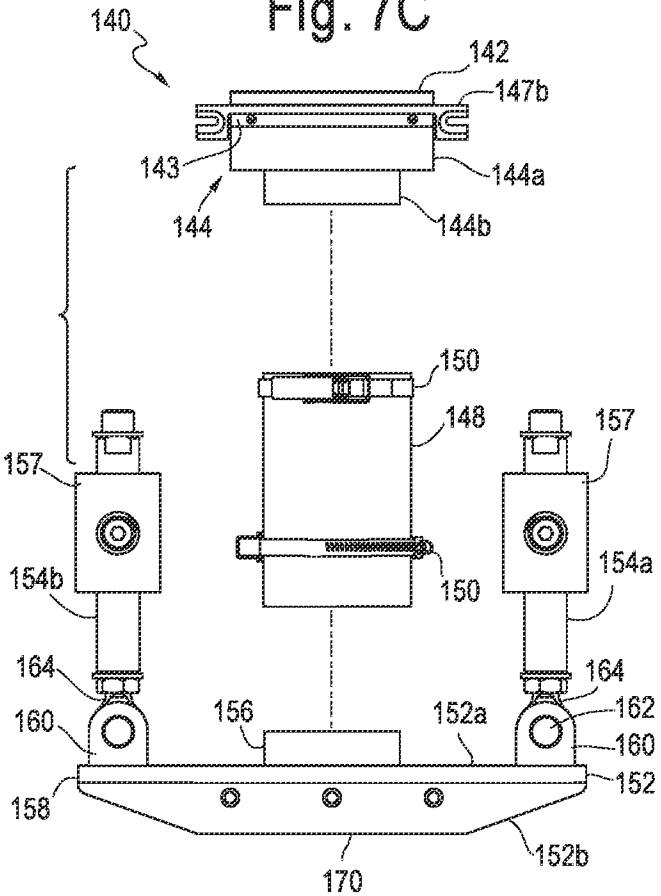
FIG. 7C shows a side view a valve portion, a tube, a plate portion, and two shafts of the device of FIG. 1.
Figure 7F:
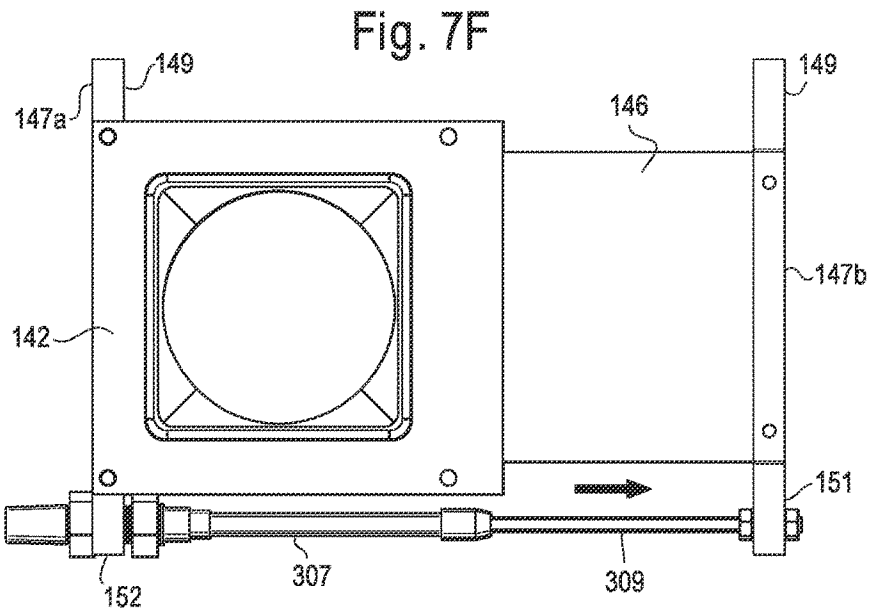
FIG. 7F shows a top view of the valve of the device of FIG. 1 in the open position.
Figure 7E:
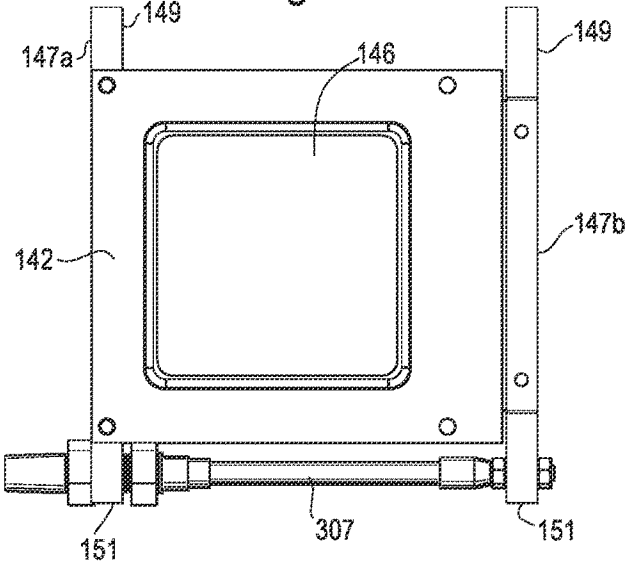
FIG. 7E shows a top view of a valve of the device of FIG. 1 in the closed position.

As shown in FIGS. 6 and 7C, the bottom 106 of the hopper 102 is connected to an adaptor 140. The adaptor 140 includes a top portion 142, a bottom portion 144, and a valve 146 positioned between the top portion 142 and the bottom portion 144. The top portion 142 of the adaptor 140 is preferably rectangular or square shaped and includes a top opening, a bottom opening, and a conduit between the top and bottom openings, as shown in FIGS. 7E-7F.

The shape of the top and bottom openings and the conduit of the top portion 142 of the adaptor 140 are the same shape as the bottom 106 of the hopper 102. For example, the bottom 106 of the hopper 102, as shown in FIG. 3, has a square shape, and therefore the top and bottom openings and the conduit of the top portion 142 of the adaptor 140 will also have a square shape, as shown in FIGS. 7E-7F. However, if the bottom 106 of the hopper 102 has a circular shape, then the top and bottom openings and the conduit of the top portion 142 of the adaptor 140 will also have a circular shape. The dimensions of the top and bottom openings and the conduit of the top portion 142 may be slightly larger than the dimensions of the bottom 106 of the hopper 102 so that the bottom 106 of the hopper 102 may fit in the top opening and part of the conduit of the top portion 142. The material 204 may flow through the bottom opening 106*a* of the hopper 102 and through the top and bottom openings and the conduit of the top portion 142 of the adaptor 140. One or more gaskets (not shown), such as an O-ring or other elastomeric gasket with a square or circular shape, may be positioned within or near the top opening and the bottom opening of the top portion 142 of the adaptor 140 to create a seal and prevent leakage of the material 204.

The bottom portion 144 of the adaptor 140 includes a first part 144*a* and a second part 144*b*, as shown in FIG. 7C. The first part 144*a* and second part 144*b* are integral with one another. The first part 144*a* has the same shape as the top portion 142 of the adaptor, for example, a generally square shape. The first part 144*a* of bottom portion 144 has a top opening, a bottom opening, and a conduit between the top and bottom openings. The top opening may have a generally square shape and the bottom opening may have a generally circular shape. Thus, the walls of the conduit may taper from the square shape of the top opening to the circular shape of the bottom opening, as shown in FIG. 7F.

The second part 144*b* of the bottom portion 144 of the adaptor 140 has a circular shape and is hollow. The diameter of the bottom opening of the first part 144*a* of the bottom portion 144 is the same as the inner diameter of the second part 144*b* of the bottom portion 144. Thus, the channel within the bottom portion 144 of the adaptor 140, starting from the top opening of the first part 144*a*, through the conduit and the bottom opening of the first part 144*a*, and then through the second part 144*b*, begins with a generally square shape and transitions to a generally circular shape.

As described above, the valve 146 is positioned between the top portion 142 and the first part 144*a* of the bottom portion 144 of the adaptor 140 and includes a plate. The valve 146 may also slide through a slot located on the bottom surface of the top portion 142 of the adaptor 140. The valve 146 is a mechanically actuated valve that regulates the flow of material 204 from the hopper 102 through the adaptor 140 and shuts off the flow of material 204. The valve 146 may be connected to the lever assembly 303 of the machine 300 via the cable 309. The forward and backward movement of the lever 305 of the lever assembly 303 manipulates the cable 309 within the rod 307, which in turn manipulates the valve 146.

The first part 144*a* of the bottom portion 144 of the adaptor 140 may also include an angled cutout 143 to position a blade wiper below the valve 146. The blade wiper (not shown) is positioned along the angled cutout 143 such that when the valve 146 moves out of the adaptor 140, the blade wiper may scrap and remove any excess material 204 off of the valve 146 and prevent any buildup of material 204 on the valve 146.

As shown in FIGS. 7E and 7F, the adaptor 140 also includes at least two clamps 147*a*, 147*b* positioned on opposite sides of the adaptor 140 and on opposite sides of the valve 146. The clamps 147*a*, 147*b* also facilitate actuation of the valve 146 and the cable 309 within the rod 307. Specifically, the clamps 147*a*, 147*b* may include a generally H-shape including a length and first and second ends 149, 151 each comprising an opening, as shown in FIG. 7C. As shown in FIGS. 7E and 7F, the clamp 147*a* may be stationary and not connected to the valve 146. The rod 307 may pass through the opening of the second end 151 of the clamp 147*a* and be mechanically fastened or connected to the clamp 147*a*, such as with screws, bolts, nuts, and/or washers, on opposite sides of the second end 151 of the clamp 147*a* to prevent movement of the rod 307. The clamp 147*b* may be connected to the valve 146 and not stationary. The cable 309, which exits the end of the rod 307, may pass through the opening of the second end 151 of the clamp 147*b*, and the cable 309 may be mechanically connected to the clamp 147*b*, such as with screws, bolts, nuts, and/or washers, on opposite sides of the second end 151 of the clamp 147*b*.

As shown in FIGS. 1 and 7E, when the lever 305 of the lever assembly 303 is pulled back, the cable 309 within the rod 307 also pulls back, which in turns pulls the valve 146 into the adaptor 140 via the clamp 147*b* and shuts off the flow of material 204 through the adaptor 140, also known as the closed position of the valve 146. When the lever 305 of the lever assembly 303 is pushed forward, the cable 309 also pushes forward, which in turn pushes the valve 146 out of the adaptor 140 via the clamp 147*b* and allows the material 204 to flow through the adaptor 140, also known as the open position of the valve 146 shown in FIG. 7F. The valve 146 may be fully inserted into the adaptor 140 to shut off the flow of the material 204 through the adaptor 140, partially inserted to regulate the flow of the material 204, or removed from the adaptor 140 as to not block the flow of any material 204 through the adaptor 140. Other types of valves 146 may also be used, such as a pinch valve, a gate valve, a hydraulic valve, a pneumatic valve, or an electric valve.

A second rod and cable (not shown) may also be connected to the lever assembly 303 to facilitate actuation of the valve 146. The second rod and cable may operate in the same fashion as the rod 307 and cable 309 on the opposite side of the adaptor 140. For example, the second rod may pass through the opening of the first end 149 of the clamp 147*a* and be mechanically fastened or connected to the clamp 147*a*, such as with screws, bolts, nuts, and/or washers, on opposite sides of the first end 149 of the clamp 147*a* to prevent movement of the second rod. The second cable, which exits the end of the second rod, may pass through the opening of the first end 149 of the clamp 147*b*, and the second cable may be mechanically connected to the clamp 147*b*, such as with screws, bolts, nuts, and/or washers, on opposite sides of the first end 149 of the clamp 147*b*. Thus, when the lever 305 of the lever assembly 303 is pulled back, both the second cable and the cable 309 may pull back, which in turn pulls the valve 146 into the adaptor 140 via the clamp 147*b*. When the lever 305 of the lever assembly 303 is pushed forward, both the second cable and the cable 309 push forward, which in turn pushes the valve 146 out of the adaptor 140 via the clamp 147*b*.

The device 100 also includes a flexible tube 148 that is connected to the adaptor 140, as shown in FIG. 7C. The flexible tube 148 includes a first end, a second end, an inner diameter, an outer diameter, and a length and is capable of being compressed and elongated. The first end of the flexible tube 148 is connected to the second part 144*b* of the bottom portion 144 of the adaptor 140. The inner diameter of the flexible tube 148 may be the same or slightly larger than the outer diameter of the second part 144*b* such that the tube 148 fits over the outer diameter of the second part 144*b* of the bottom portion 144 of the adaptor 140. The first end of the flexible tube 148 is connected to the second part 144*b* of the bottom portion 144 of the adaptor 140 via a mechanical fastening belt 150, such as a hose clamp known in the art. The second end of the flexible tube 148 is connected to a plate portion 152 of the device 100, described in greater detail below.

The material 204 may flow through the adaptor 140 and the flexible tube 148 and toward the plate portion 152. The flexible tube 148 may be replaced as needed over time and after repeated usage of the device 100. The flexible tube 148 may also include one or more springs (not shown) within the flexible tube 148 to facilitate movement of the flexible tube 148 and absorb energy. The material of the flexible tube 148 may include any flexible hose that is capable of collapsing under deflection without deforming and blocking the flow of material 204. For example, the flexible tube 148 may include a collapse-resistant rubber or metal hose that has a spring core to maintain its shape.

The plate portion 152 of the device 100 is the part of the device 100 that contacts the ground during the reinstatement process, as shown in FIG. 1. The machine 300 may lower the device 100 so that the plate portion 152 makes positive contact with the pavement 202. The gravitational weight of the device 100, in particular when the hopper 102 is filled with material 204, applies a force to the plate portion 152 that helps the plate portion 152 maintain positive contact with the pavement 202 during operation, even when the surface of the pavement 202 is uneven or angled.

Figure 7G:
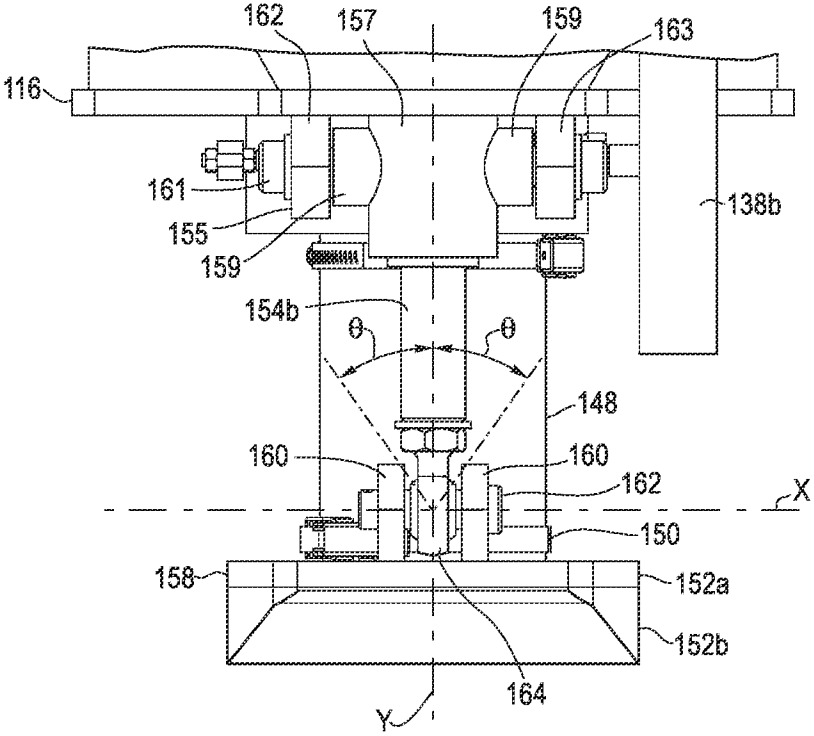
FIG. 7G shows a side view of one of the shafts of the device of FIG. 1.

The plate portion 152 is flexible and dynamic via a pair of shafts 154*a*, 154*b*, described in greater detail below, and the flexible tube 148 that allow the plate portion 152 to move to adapt to the surface of the pavement 202 to maintain positive contact with the pavement 202, such as when the surface of the pavement 202 is uneven or angled. Specifically, the shafts 154*a*, 154*b* and the flexible tube 148 allow the plate portion 152 to move up and down a vertical axis Y and also allow for some pivoting or deflection of the plate portion 152 from the vertical axis Y, as shown in FIG. 7G. The plate portion 152 may pivot or deflect from the vertical axis Y at the angle θ shown in FIG. 7G, which may be approximately up to 15 degrees in either direction, before the interfering with a set of parallel plates 160, described in more detail below. For example, even if the machine 300 and/or the hopper 102 are angled with respect to the surface of the pavement, the dynamic and flexible features of the plate portion 152 allow the plate portion 152 to maintain positive contact with the pavement 202. The flexible and dynamic features of the plate portion 152 also prevent damage to the plate portion 152 when traversing along the pavement 202.

The plate portion 152 includes a connecting plate 152*a* and a skid plate 152*b*, as shown in FIG. 7C. The material of the connecting plate 152*a* may include steel. The connecting plate 152*a* includes a first portion 156 and a second portion 158, which are integral with one another. The first portion 156 is a circular shaped conduit that includes an outer diameter that is the same as or slightly smaller than the inner diameter of the flexible tube 148 to allow the second end of the flexible tube 148 to slide over and around the first portion 156 of the connecting plate 152*a*. The flexible tube 148 is connected to the first portion 156 of the connecting plate 152*a* via another mechanical fastening belt 150, such as a hose clamp known in the art.

The second portion 158 of the connecting plate 152*a* is a plate that includes a circular top opening, a circular bottom opening, and a circular conduit between the top and bottom openings that correspond with the circular shaped first portion 156 of the connecting plate 152*a*. The inner diameter of the first portion 156 is the same as the diameter of the top and bottom openings and the conduit of the second portion 158 of the connecting plate. Thus, the channel within the connecting plate 152*a*, starting from the first portion 156 and then through the top opening, the conduit, and the bottom opening of the second portion 158, has a continuous circular shape with the same diameter throughout the channel to allow material 204 to flow through the connecting plate 152*a*.

Figure 5:
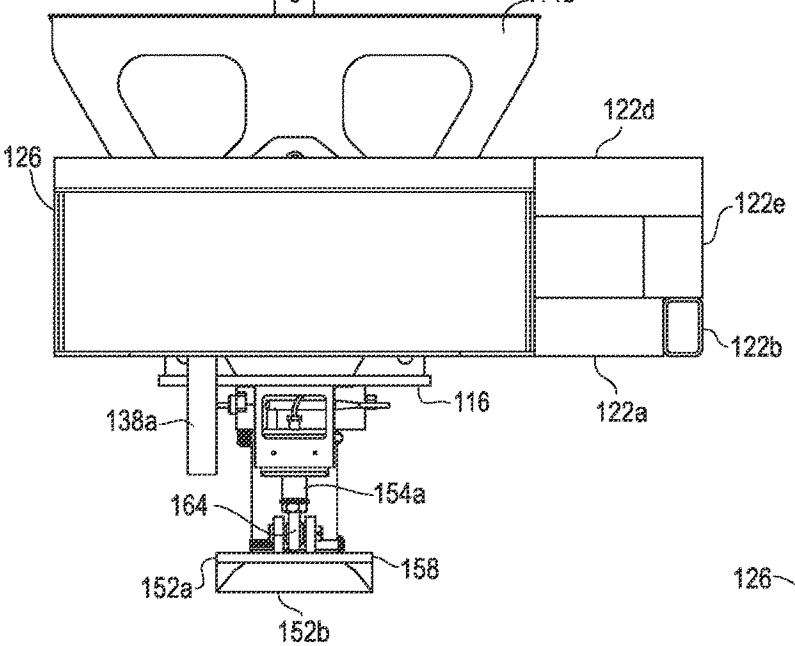
FIG. 5 shows a rear view of the device of FIG. 1.

The shafts 154*a*, 154*b* are connected to the second portion 158 of the connecting plate 152*a* via two yokes, clevises or two sets of parallel plates 160 positioned on the top surface of the second portion 158 of the connecting plate 152*a*, as shown in FIGS. 5, 7C and 7G, and on opposite ends of the second portion 158. Each of the shafts 154*a*, 154*b* includes a first end and a second end.

The first end of each shaft 154*a*, 154*b* includes a mechanically connected, via screws, bolts, nuts, and/or washers, or integral, via welding, bonding, or adhesive, bearing 164, as shown in FIGS. 5 and 7G. The bearing 164 allows a shaft or clevis pin 162 to slide through the bearing 164, and the shaft 154*a*, 154*b* slides through holes in the parallel plates 160 and then may be connected to the parallel plates 160 via nuts and washers. This configuration creates a gimbal effect and allows for movement of the plate portion 152 as described above. In an alternative embodiment, the first end of each shaft 154*a*, 154*b* may include a ball joint to connect each shaft 154*a*, 154*b* to the connecting plate 152*a*. The second end of each shaft 154*a*, 154*b* is positioned through holes in the bottom panel 116 of the sub-frame assembly, which allow the shafts 154*a*, 154*b* to move up and down the vertical axis Y through the bottom panel 116 of the sub-frame assembly.

To maintain the position of the shafts 154*a*, 154*b* within the center of the holes in the bottom panel 116, each shaft 154*a*, 154*b* passes through a support assembly 155 prior to entering the hole within the bottom panel 116. As shown in FIG. 7G, the support assembly 155 includes a cylinder 157, two connecting cylinders 159, a rod 161 within each connecting cylinder 159, and a yoke, clevis or two parallel plates 163 positioned on the bottom surface of the bottom panel 116 of the sub-frame assembly, as shown in FIG. 7G.

The parallel plates 163 each include a hole for positioning each rod 161 within the hole of each plate 163. Each rod 161 may be mechanically connected to each plate 163 via nuts and washers to prevent movement of the rod 161 and respective connecting cylinder 159. Each connecting cylinder 159 may be integral with the cylinder 157 via a weld, bond or adhesive. Within each cylinder 157, each shaft 154*a*, 154*b* may move freely along the vertical axis Y within each cylinder 157. The shafts 154*a*, 154*b* may also be lubricated with oil-embedded brass bushing or other lubricants to facilitate movement of the shafts 154*a*, 154*b* within each cylinder.

As shown in FIGS. 4 and 7C, the skid plate 152*b* of the plate portion 152 may be connected to the connecting plate

152*a* via an integral connection, such as a weld, bond, or adhesive or via a mechanical connection, such as screws, bolts, nuts, and/or washers. The material of the skid plate 152*b* may include a nylon-based plastic, abrasion-resistant steel, or an adhesive and chemical resistant plastic, such as high-density polyethylene.

The skid plate 152*b* has a top opening, a bottom opening 166, and a conduit 168 between the top opening and bottom opening 166. The shape of the top opening, the bottom opening 166, and the conduit 168 is designed to have the same shape as the micro-trench 200, which facilitates precise placement of the material 204 into the micro-trench 200. For example, if the micro-trench 202 has a rectangular shape and a width of two inches, then the top opening, the bottom opening 166, and the conduit 168 of the skid plate 152*b* will also include a rectangular shape and have a width of two inches. As the length of the micro-trench 200 may be significant, i.e. miles, the length of the top opening, the bottom opening 166, and the conduit 168 may vary. In one embodiment, the length may be six inches. Thus, material 204 may flow through the skid plate 152*b* to the micro-trench 200 to backfill the micro-trench 200 with material 204, as shown in FIG. 1. The bottom surface 170 of the skid plate 152*b*, as shown in FIG. 7C, that contacts the ground is also generally flat to traverse along the pavement 202 and also levels out the material 204 after it is poured into the micro-trench 200 to restore the pavement 202 to its original surface level prior to the micro-trenching.

The device 100 may also include at least two cameras 172. The cameras 172 may be connected to the display 302 of the machine 300 via the cables 306 and allows the feedback from the cameras 172 to be displayed on the display 302 for the operator of the machine 300. The cameras 172 provide the operator of the machine 300 with a visual of the position of the plate portion 152 with respect to the micro-trench 200 to facilitate precise placement of the plate portion 152 over the micro-trench 200 during operation. The cameras 172 also provide the operator of the machine 300 with a visual of the amount and level of material 204 within the micro-trench 200 during operation to ensure that the micro-trench 200 is properly filled without underfilling or overfilling the micro-trench 200.

As shown in FIGS. 6 and 7D, each camera 172 is positioned within a covering mount 174 that protects the camera 172. The covering mount 174 is connected to the bottom panel 116 of the sub-frame assembly via an integral connection, such as a weld, bond, or adhesive or via a mechanical connection, such as screws, bolts, nuts, and/or washers. One of the cameras 172 is positioned to view the front 176 of the plate portion 152 and the micro-trench 200, and the other camera 172 is positioned to view the rear 178 of the plate portion 152 and the micro-trench 200. The positioning of the cameras 172 allows the operator of the machine 300 to visually see the location of the plate portion 152 relative to the micro-trench 200. The cameras 172 may also include lights to allow the operator of the machine 300 and device 100 to utilize the device 100 in environments that are dark, such as during non-daylight hours, in tunnels or under bridges.

Advantageously, the present embodiments increase the efficiency of reinstatement of a micro-trench by using a device that is machine powered to provide for faster deployment of the back-fill material within the micro-trench. For example, the device may be able to reinstate 500 to 5,000 feet per day of a micro-trench. The increased efficiency allows for faster deployment and the pavement to be restored to its original condition faster, which minimizes disruptions to traffic, pedestrians and residents.

As another advantage, the present embodiments also provide for more controlled, precise and proper reinstatement of the micro-trench. For example, the device includes a plate portion that levels the back-fill material within the micro-trench so the pavement level is restored to its original condition prior to micro-trenching. The plate portion also includes a conduit and bottom opening that are the same shape and have the same or similar width as the micro-trench to pour the material in a controlled and precise manner into the micro-trench and not outside of the micro-trench. The plate portion is also dynamic and flexible due to shafts and a flexible tube to ensure the plate portion maintains positive contact with the pavement during operation even if the surface of the pavement is uneven or angled. The cameras, and the lights on the cameras, also allow the operator of the machine-powered device to know where the plate portion is located in relation to the micro-trench and to move the device to properly position the plate portion over the micro-trench. Also, the valve portion allows the operator of the machine and the device to regulate the flow of material to the micro-trench.

Manual-Powered Device for Reinstatement of a Micro-Trench

Figure 9:
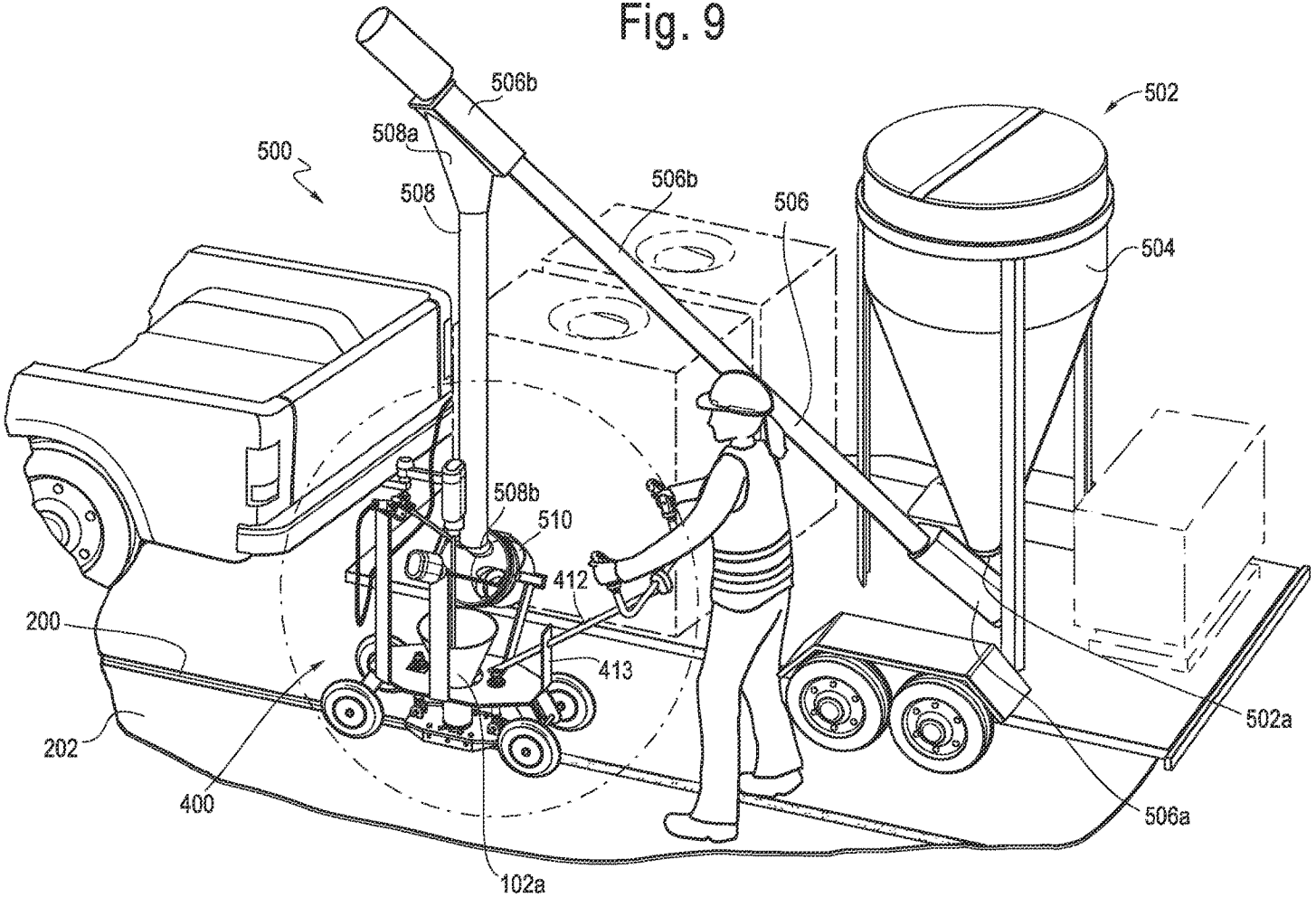
FIG. 9 shows a perspective view of an embodiment of a manual-powered device for reinstatement of a micro-trench in use.
Figure 10:
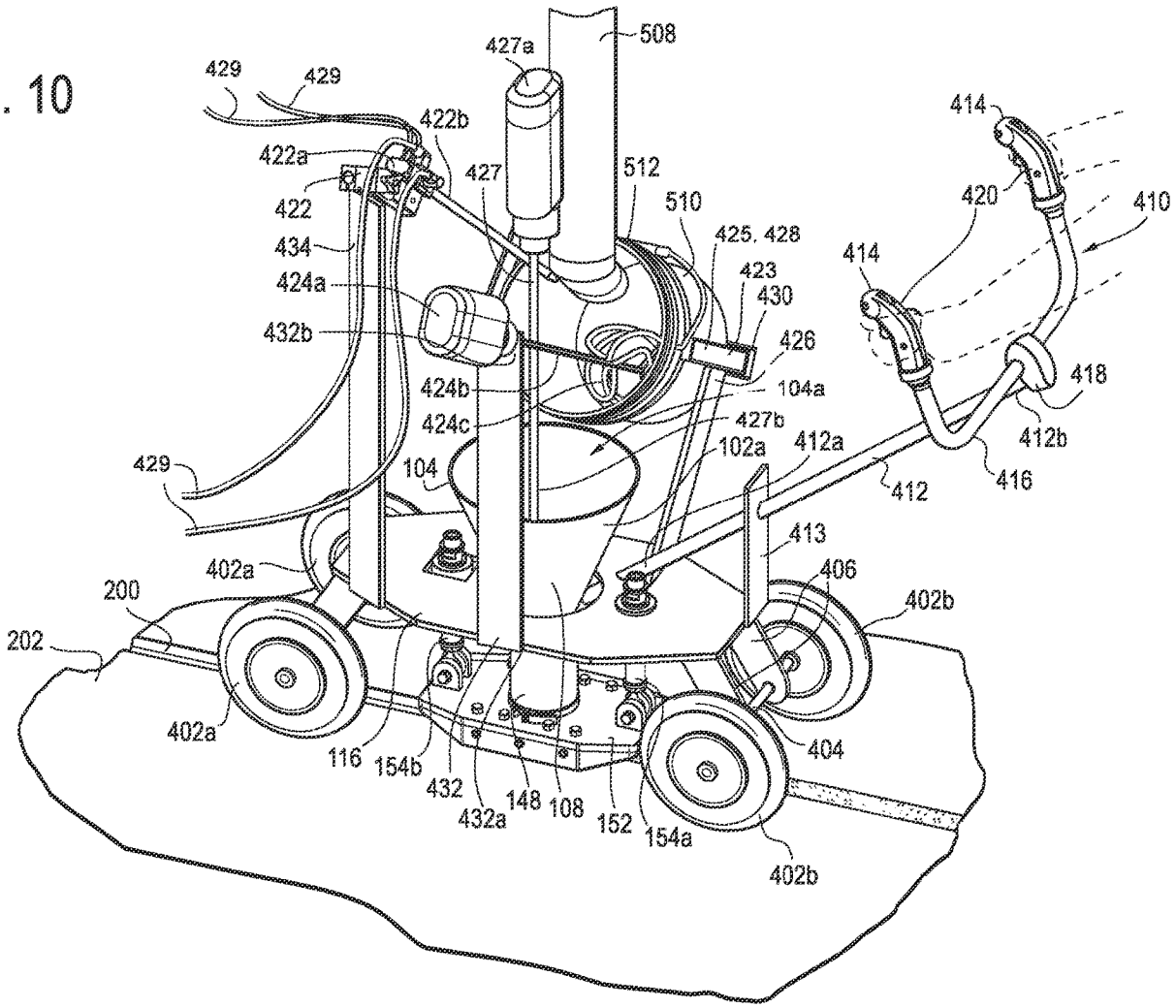
FIG. 10 shows an exploded perspective view of the device of FIG. 9 that is taken along the dotted circular line of FIG. 9.

FIGS. 9-10 show an embodiment of a device 400 for reinstatement of the micro-trench 200. As compared to the device 100 described above, the device 400 is advanced or pushed along the pavement 202 manually by a user of the device 400, as shown in FIG. 9, or, in other words, is pushed along the pavement 202 without the use of a machine. The detailed descriptions of the elements described above for the device 100 that are also used in the device 400 are not repeated in detail here, and the following description provides a description of device 400 that includes and identifies the differences between the device 100 and the device 400.

Similar to the device 100, the device 400 advantageously includes the plate portion 152 that levels the back-fill material within the micro-trench 200 so the pavement level is restored to its original condition prior to micro-trenching. As described above regarding device 100, the plate portion 152 also includes the conduit 168 and the bottom opening 166 that are the same shape and have the same or similar width as the micro-trench 200 to pour the material 204 in a controlled and precise manner into the micro-trench 200 and not outside of the micro-trench 200. The plate portion 152 is also dynamic and flexible due to the shafts 154*a*, 154*b* and the flexible tube 148 to ensure that the plate portion 152 maintains positive contact with the pavement 202 during operation even if the surface of the pavement 202 is uneven or angled. The device 400 also advantageously includes the valves 146 that allow the operator of the device 400 to regulate the flow of material 204 to the micro-trench 200. The gravitational weight of the device 400, in particular when the hopper 102*a* is filled with material 204*a*, advantageously applies a force to the plate portion 152 that helps the plate portion 152 maintain positive contact with the pavement 202 during operation, even when the surface of the pavement 202 is uneven or angled.

FIG. 9 shows the device 400 being manually pushed along the pavement 202 by an operator of the device 400 over the micro-trench 200. In one embodiment, the material 204*a* used to reinstate the micro-trench 200 may be the same material as the material 204 used with the device 100. In a second embodiment, shown in FIGS. 9-10, the material

204*a* may include a faster setting material that is capable of being mixed at or near the point of application rather than mixed prior to application. Specifically, the ability to have the material 204*a* mixed at or near the point of application allows for a continuous and efficient mixing process and use of a material for reinstatement of the micro-trench 200 that sets quickly and minimizes the time required to wait for material to be mixed prior to applying the material to the micro-trench 200 for reinstatement.

As shown in FIG. 9, a truck or machine 500 travels alongside the device 400 during reinstatement. The truck 500 includes a silo or similar storage component 502 that stores aggregate 504 and that includes an opening 502*a* located at a bottom portion of the silo 502 to dispense the aggregate 504. Aggregate 504 may include rock, sand, gravel, and/or stone that is used to mix with cement and water to form concrete to reinstate the micro-trench 200.

The truck 500 also includes an auger 506 for transferring the aggregate 504 from the silo 502 to the device 400. The auger 506 includes a first end portion 506*a*, a second end portion 506*b*, and a cylindrically shaped body 506*c*. The first end portion 506*a* of the auger 506 is positioned below the silo 502 to receive the aggregate 504 dispensed from the opening 502*a* of the silo 502. The auger 506 extends at an angle from the first end portion 506*a* located below the silo 502 toward the second end portion 506*b* that is positioned above the device 400.

The second end portion 506*b* of the auger 506 is connected to a tube 508. The tube 508 includes a first end portion 508*a*, a second end portion 508*b*, and a cylindrically shaped body 508*c*. The first end portion 508*a* of the tube 508 is connected to the second end portion 506*b* of the auger 506. The tube 508 extends from the second end portion 506*b* of the auger 506 vertically down toward the device 400, as shown in FIG. 9. The second end portion 508*b* of the tube 508 is curved to position the aggregate 504 into a cylindrically shaped container or bucket 510 that includes an opening 512 for mixing of the aggregate 504 with water and cement to form the material 204*a* and pouring the material 204*a* into the hopper 102*a* of the device 400, described in more detail below.

To facilitate manual pushing of the device 400 along the pavement 202 to reinstate the micro-trench 200, the device 400 includes a plurality of wheels 402. The plurality of wheels 402 includes a pair of front wheels 402*a* and a pair of rear wheels 402*b*. The pair of front wheels 402*a* are connected to each other via an axle 404, and the pair of rear wheels 402*b* are connected to each other via an axle 404. Each axle 404 is connected to the bottom panel 116 of the device 400 via one or more panels 406. The panels 406 may include a hole 408 adjacent to one end, and the panels 406 are coupled or otherwise connected to each axle 404 via the axle 404 being inserted into and passing through the hole 408 of each panel 406. The axle 404 may be adhesively adhered or welded to the panels 406 to minimize movement of the panels 406 along the axle 404; however, this is not required. The panels 406 are welded or mechanically connected to the bottom panel 116 of the device 400.

The device 400 also includes a steering component 410 to push the device 400 along the pavement 202. A rod 412 connects the steering component 410 to the bottom panel 116 of the device 400. The rod 412 includes a first end portion 412*a* that is connected to the bottom panel 116 of the device 400 and a second end portion 412*b* that is connected to the steering component 410. The rod 412 extends at an angle from the bottom panel 116. To maintain its angled position, the rod 412 is supported by a panel 413 that is integrally or mechanically connected to the bottom panel 116, oriented vertically from the bottom panel 116 at an approximately 90-degree angle from the bottom panel 116, and located toward the rear of the bottom panel 116, as shown in FIGS. 9-10. The panel 413 includes a hole in which the rod 412 passes through, and the rod 412 may be adhesively connected or welded to the panel 413 near the hole of the panel 413 or the rod 412 may pass through the hole of the panel 413 without any adhesive or weld.

The steering component 410 includes at least two handles 414, a curved bar 416, and a coupling element 418. The coupling element 418 includes a hole for insertion of the second end portion 412*b* of the rod 412 and a hole for insertion of the curved bar 416 through the coupling element 418. The curved bar 416 connects the at least two handles 414 to each other and is perpendicular to the rod 412. The coupling element 418 allows for some rotation of the steering component 410 to facilitate steering of the device 400 along the pavement 202. Thus, the curved bar 416 may be fixed within the coupling element 418 such that the curved bar 416 does not slide within the coupling element 418 during operation, and the rod 412 is connected to the coupling element 418 such that the coupling element 418 may rotate around the second end portion 412*b* of the rod 412. The first end portion 412*a* of the rod 412 may be welded or mechanically connected to the bottom panel 116 of the device 400.

Each of the handles 414 of the steering component 410 includes a trigger 420. The trigger 420 for one of the handles 414 may control the valve 146 to open and close the valve 146 of the adaptor 140. The trigger 420 may be electronically connected with the valve 146 or the trigger 420 may be connected to the cable 309, as described with device 100, to manipulate the valve 146. The trigger 420 for one of the handles 414 also electronically controls a dispensing gun 422 of the device 400, described in more detail below. One of the handles 414 may also include an additional trigger, switch or control (not shown) that electronically or pneumatically controls the flow of aggregate 504 through the auger 506.

As shown in FIGS. 9 and 10, the device 400 includes a hopper 102*a*. The hopper 102*a* of the device 400 is similar to the hopper 102 of the device 100 except that the shape of the hopper 102*a* is cylindrically shaped and includes one wall 108. In an alternate embodiment, the hopper 102*a* of the device 400 may have the same shape as the hopper 102 of the device 100. Similar to the hopper 102, the hopper 102*a* includes the top 104, the top opening 104*a*, the bottom 106, and the bottom opening 106*a*. The hopper 102*a* is a container for the material 204*a* that tapers downward and is able to discharge the material 204*a* through the bottom opening 106*a*. The top opening 104*a* includes a width 104*b* that is larger than the width 106*b* of the bottom opening 106*a*. The material and dimensions of the hopper 102*a* may be the same as described above regarding hopper 102. Also, the wall 108 may include a smooth surface to allow for easy scraping of the material 204*a* off of the wall 108, and/or a liner or other material, such as a type of grease, may be applied to the wall 108 to help prevent buildup of material 204*a* on the wall 108 and ease removal of excess material 204*a* from the wall 108.

In one embodiment, the device 400 may include the entirety of the sub-frame assembly described above for device 100. In a second embodiment, as shown in FIGS. 9-10, the device 400 only includes the bottom panel 116 of the sub-frame assembly of the device 100.

The bottom panel 116 of the device 400 includes a mount 423 that extends vertically from the top of the bottom panel 116, as shown in FIG. 10, The mount 423 holds the bucket 510 and is capable of rotating the bucket 510 from a vertical position for storage and a horizontal position for use. FIGS. 9-10 show the bucket 510 in the horizontal position for use. The mount 423 is positioned adjacent to the hopper 102*a* such that when the bucket 510 is in the horizontal position for use, the bucket 510 is at least partially positioned over the top opening 104*a* of the hopper 102*a* to allow the material 204*a* to flow out of the bucket 510 into the hopper 102*a*. The mount 423 includes two side panels 426 that extend vertically from the bottom panel 116 at an approximately 90-degree angle. The mount 423 also includes a mount portion 425 that includes two side panels 428 and a horizontal panel 430 that connects the two side panels 428. One of the two side panels 428 of the mount portion 425 is mechanically and rotatably connected to one of the two side panels 426, and the second of the two side panels 428 of the mount portion 425 is mechanically and rotatably connected to the second of the two side panels 426. The bucket 510 is positioned within the mount portion 425 such that the bottom of the bucket 510 rests on the horizontal panel 430 of the mount portion 425 and the cylindrically shaped wall of the bucket 510 is positioned between the two side panels 428.

On the side of the hopper 102*a* opposite to the mount 423, the device 400 includes an additional panel 432. The panel 432 extends vertically from the bottom panel 116 of the device 400 at an approximately 90-degree angle from the bottom panel 116. The panel 432 includes a first end portion 432*a* and a second end portion 432*b*. The first end portion 432*a* is integrally or mechanically connected to the bottom panel 116, and a mixer or stirrer 424 is coupled or otherwise connected to the second end portion 432*b* of the panel 432. The panel 432 supports the mixer 424, which mixes the aggregate 504, water and cement together to form the material 204*a*. The mixer 424 includes a handle 424*a*, a rod 424*b*, and a beater 424*c*. The mixer 424 is connected to the panel 432 along the rod 424*b*, and the beater 424*c* is positioned within the bucket 510. The mixer 424 is rotatably and mechanically connected to the panel 432 that allows the beater 424*c* is rotate around the bucket 510. In another embodiment, the panel 432 may include a hole in which the rod 424*b* is positioned through to support the mixer 424. The mixer 424 may be operated manually via the handle 424*a* or electronically. For example, an additional trigger, switch or control (not shown) on the steering component 410 may be electronically connected to the mixer 424 to control the speed, rotation, and power of the mixer 424. The mixer 424 allows for mixing at the point of application, as described above as an advantage of the device 400.

The device 400 also includes an additional mixer or stirrer 427. The mixer 427 is positioned within the hopper 102*a* to facilitate movement of the material 204*a* within the hopper 102*a*. The mixer 427 includes a handle 427*a*, a rod 427*b*, and a beater 427*c* (not shown). The beater 427*c* may include a solid round or square element to push the material 204*a* through the hopper 102*a* or a beater including one or more rotary blades to facilitate additional mixing and movement of the material 204*a* throughout the hopper 102*a*. Similar to the mixer 424, the mixer 427 may be operated manually via the handle 427*a* or electronically. For example, an additional trigger, switch or control (not shown) on the steering component 410 may be electronically connected to the mixer 427 to control the speed, rotation, and power of the mixer 427. The mixer 427 is connected or coupled to a stand or panel (not shown) that allows the mixer 427 to maintain its vertical positioning within the hopper 102*a*.

The device 400 also includes the dispensing gun 422. The dispensing gun 422 is supported by a panel 434 that is integrally or mechanically connected to the bottom panel 116 and extends vertically from the bottom panel 116 at an approximately 90-degree angle. The panel 434 is positioned along the same side of the bottom panel 116 as the panel 432 that supports the mixer 424. At least two tubes 429 are connected to the dispensing gun 422. One of the at least two tubes 429 is connected to a water supply of the truck 500, and the second of the at least two tubes 429 is connected to a cement supply of the truck 500. The dispensing gun 422 dispenses water and cement to the bucket 510 for mixing with the water and cement with the aggregate 504 to form material 204*a*. Additional tubes 429 may be connected to the dispensing gun 422 to provide additional materials to the bucket 510 for mixing. The dispensing gun 422 includes a main component 422*a* and a tube 422*b*. The main component 422*a* is integrally or mechanically connected to the panel 434. The at least two tubes 429 are connected to the main component 422*a*, and the main component 422*a* is integral with or mechanically connected to the tube 422*b*. The water and cement flow through the tubes 429 and into the tube 422*b*, and an end portion of the tube 422*b* is positioned within the bucket 510, as shown in FIGS. 9-10. The main component 422*a* controls whether one or both of the water and cement flow through the tube 422*b*. The dispensing gun 422 is electronically controlled via one of the triggers 420 of the steering component 410 as described previously above.

The mechanics and elements of the device 400 below and underneath the bottom panel 116 are the same as described above regarding the device 100. For example, the bottom 106 of the hopper 102*a* of the device 400 is connected to the adaptor 140 and includes the valve 146. As described above, the valve 146 of the device 100 may be connected and controlled, electronically or via the cable 309, to one of the triggers 420 of the steering component 410. Also, as described above regarding the device 100, the device 400 also includes the flexible tube 148 that is connected to the adaptor 140, and the plate portion 152 that is flexible and dynamic via the pair of the shafts 154*a*, 154*b* and the flexible tube 148 and that is connected to the flexible tube 148. The bottom panel 116 of the device 400 also includes the holes to allow each shaft 154*a*, 154*b* to pass through the holes, and the device 400 also includes the support assembly 155 that maintains the positioning of the shafts 154*a*, 154*b* within the center of the holes of the bottom panel 116. The device 400 may also include the cameras 172 (not shown), and the lights on the cameras, to allow the operator of the device 400 to know where the plate portion 152 is located in related to the micro-trench 200 and to move the device 400 to properly position the plate portion 152 over the micro-trench 200. In addition, the steering component 410 may also include a display, similar to the display 302 on the machine 300, to enable the operator of the device 400 to see the readout from the cameras 172 during operation.

Figure 11:
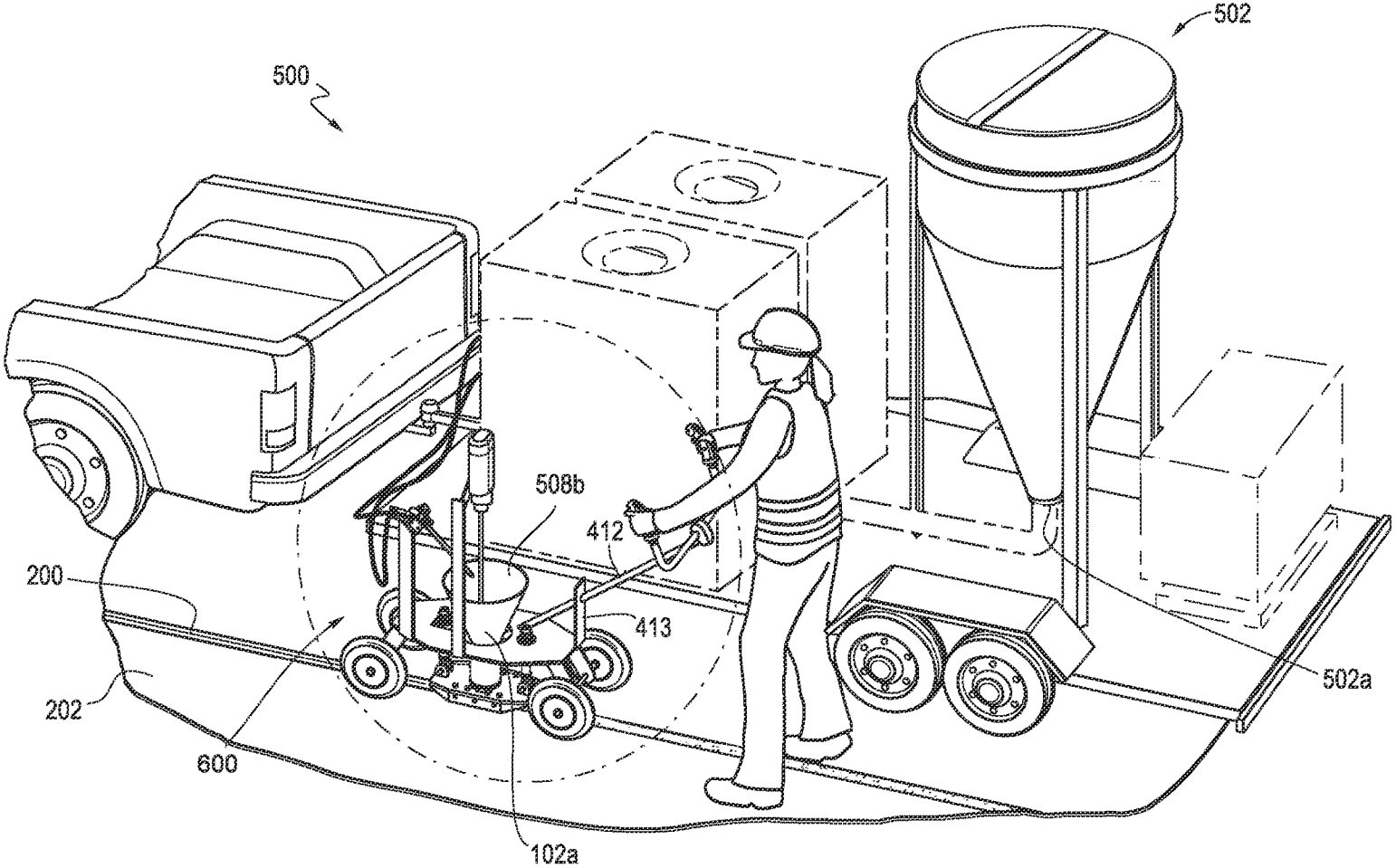
FIG. 11 shows a perspective view of a second embodiment of a manual-powered device for reinstatement of a micro-trench in use.
Figure 12:
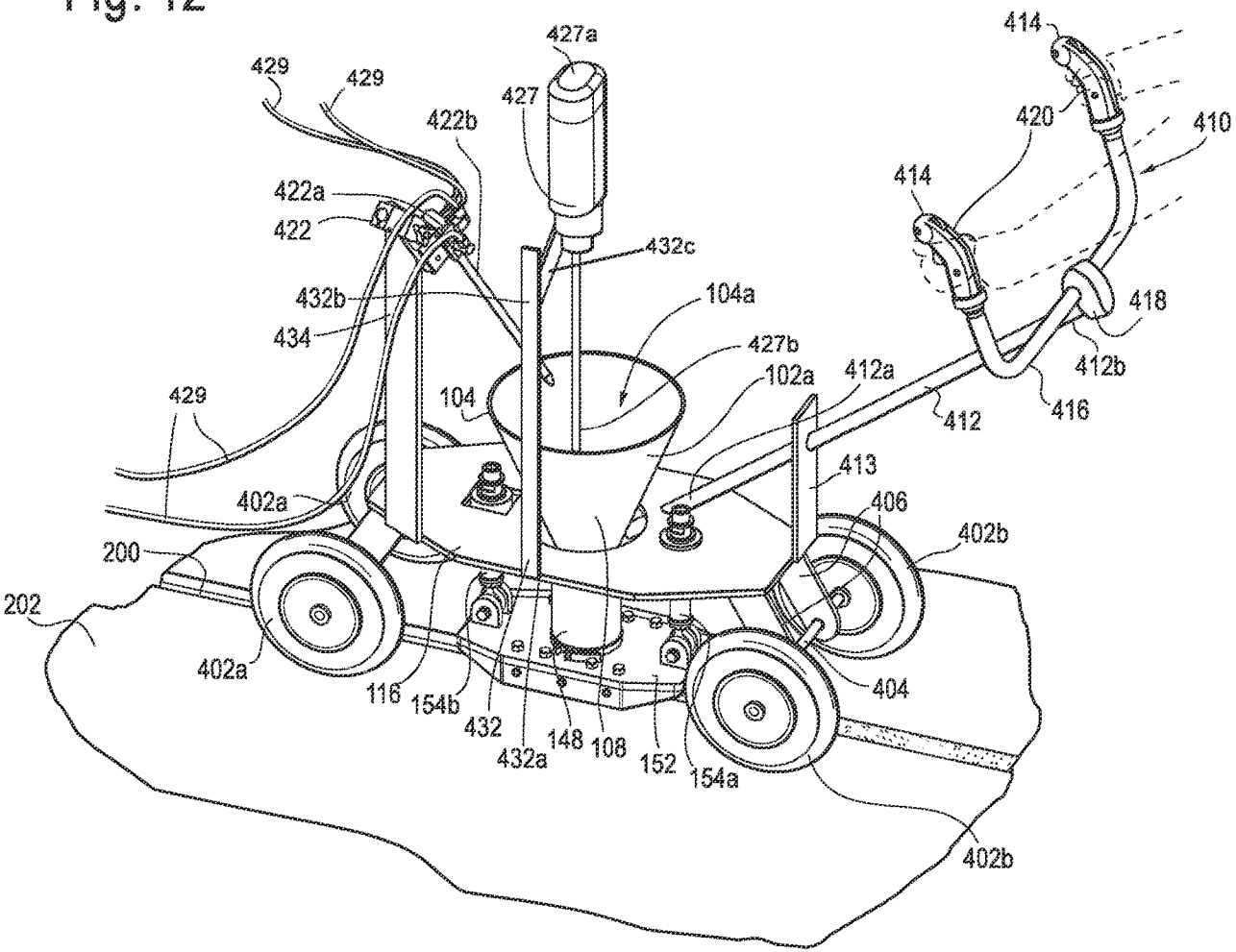
FIG. 12 shows an exploded perspective view of the device of FIG. 11 that is taken along the dotted circular line of FIG. 11.

FIGS. 11-12 show a second embodiment of the device 600 for reinstatement of the micro-trench 200. The difference between the device 400 described above and the device 600 is that rather than conducting point of application mixing of the cement, water, and aggregate that is available using the device 400, the device 600 allows for use of a pre-mixed mixture of material 204*a*, including for example cement, water, and aggregate, that may flow through one or more of the tubes 429 of the device 600 into the hopper 102*a*. The pre-mixed mixture of material 204*a* may flow from a storage component, the silo 502, a rotating mixer, or another component positioned on the truck or machine 500 and through the tubes 429. As shown in FIGS. 11-12, the device 600 does not include the auger 506, the tube 508, the mount 423 and corresponding mount portion 425 for the bucket 510, and the mixer 424. Rather, the pre-mixed mixture may flow through the tubes 429 connected to the dispensing gun 422 and through the tube 422*b* of the dispensing gun 422 into the hopper 102*a*. However, one of skill in the art would know that the embodiment shown in FIGS. 9-10 may be combined with the embodiment shown in FIGS. 11-12 such that the device 600 may similarly maintain or include the use of the auger 506, the tube 508, the mount 423 and corresponding mount portion 425 for the bucket 510, and the mixer 424 and these components may be used when conducting point of application mixing and may not be used when using pre-mixed material 204*a*.

In FIGS. 11-12, the mixer 427 is connected to the panel 432 to support the positioning of the mixer 427 within the hopper 102*a*. The panel 432 may include an extension portion 432*c* connected to the second end portion 432*b* of the panel 432 to position the mixer 427 within the center of the top or first opening 104*a* of the hopper 102*a*. In another embodiment, an alternative stand (not shown) may be used to support the positioning of the mixer 427 and the panel 432 may not be used. The trigger 420 of at least one of the handles 414 may control the flow of material 204*a*, electronically or pneumatically, through the tubes 429 and through tube 422*b* of the dispensing gun 422 into the hopper 102*a*.

It will be appreciated by those skilled in the art that changes could be made to the embodiments described above without departing from the broad inventive concept therefore. It is understood, therefore, that this invention is not limited to the particular embodiments disclosed, but it is intended to cover modifications within the spirit and scope of the present invention as defined by the claims.

We claim:

1. A device for manual reinstatement of a micro-trench comprising a handle for manual guidance of the device;

a hopper comprising a first opening and a second opening, wherein the first opening is at a location higher than the second opening within the hopper;

a valve portion connected to the second opening of the hopper;

a tube connected to the valve portion; and a dynamic plate portion comprising a top opening, a bottom opening, and a conduit between the top and bottom openings, the top opening connected to the tube and the bottom opening comprising a length and a width.

2. The device of claim 1, wherein the valve portion comprises a top portion, a bottom portion, and a valve positioned between the top portion and the bottom portion, the top portion connected to the second opening of the hopper and the bottom portion connected to the tube.

3. The device of claim 2, wherein the valve of the valve portion is mechanically-actuated.

4. The device of claim 1, wherein the device further comprises a frame support; and wherein the hopper is positioned within the frame support and is rotatably connected to the frame support.

5. The device of claim 4, wherein the device further comprises one or more shafts connected to the frame support and the plate portion.

6. The device of claim 5, wherein the device further comprises a camera mounted to the frame support.

7. The device of claim 1 further comprising a mixer located adjacent to the hopper.

8. A device for reinstatement of a micro-trench comprising;

a hopper comprising a first opening and a second opening, wherein the first opening is at a location higher than the second opening within the hopper;

a panel that supports the hopper;

a valve portion connected to the second opening of the hopper;

a tube connected to the valve portion; and a dynamic plate portion comprising a top opening, a bottom opening, and a conduit between the top and bottom openings, the top opening connected to the tube and the bottom opening comprising a length and a width; and a plurality of wheels connected to the panel; whereby the tube allows the dynamic plate portion to move.

9. The device of claim 8, wherein the device is manually powered.

10. The device of claim 8, wherein the device is machine-powered.

11. The device of claim 8, wherein the valve portion comprises a top portion, a bottom portion, and a valve positioned between the top portion and the bottom portion, the top portion connected to the second opening of the hopper and the bottom portion connected to the tube.

12. The device of claim 8, wherein the valve of the valve portion is mechanically-actuated.

13. The device of claim 8, wherein the valve of the valve portion is electronically-actuated.

14. The device of claim 8 further comprising a mixer connected to the panel and located adjacent to the hopper.

15. A method for reinstating a micro-trench, the method comprising:

presenting a device comprising a handle for manual guidance, a hopper comprising a first opening and a second opening, wherein the first opening is at a location higher than the second opening within the hopper, a valve portion connected to the second opening of the hopper, a tube connected to the valve portion, and a dynamic plate portion comprising a top opening, a bottom opening, and a conduit between the top and bottom openings, the top opening connected to the tube;

positioning the bottom opening of the dynamic plate portion over a micro-trench;

dispensing material through the bottom opening of the dynamic plate portion into the micro-trench;

moving the hopper along the micro-trench such that the bottom opening of the dynamic plate portion maintains its position above the micro-trench; and leveling the material dispensed into the micro-trench via the dynamic plate portion.

16. The method of claim 15, wherein the moving of the hopper along the micro-trench includes machine-powered movement.

17. The method of claim 15, wherein the moving of the hopper along the micro-trench includes manual-powered movement.

18. The method of claim 15, wherein the positioning of the bottom opening of the dynamic plate portion over a micro-trench is conducted through a camera.

19. The method of claim 15, wherein the dispensing of the material further comprises dispensing the material through the hopper and the tube.

20. The method of claim 15 further comprising mixing material within a container adjacent to the hopper to enable mixing near a point of application.

* * * * *